US009964874B2

(12) United States Patent
Suzumura et al.

(10) Patent No.: US 9,964,874 B2
(45) Date of Patent: May 8, 2018

(54) TONER

(71) Applicant: CANON KABUSHIKI KAISHA, Tokyo (JP)

(72) Inventors: Yoshitaka Suzumura, Mishima (JP); Yusuke Hasegawa, Suntou-gun (JP); Tomohisa Sano, Mishima (JP); Atsuhiko Ohmori, Yokohama (JP); Kozue Uratani, Mishima (JP); Yuujirou Nagashima, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/259,293

(22) Filed: Sep. 8, 2016

(65) Prior Publication Data

US 2017/0160661 A1 Jun. 8, 2017

(30) Foreign Application Priority Data

Dec. 4, 2015 (JP) ..... 2015-237727

(51) Int. Cl.
*G03G 9/087* (2006.01)
*G03G 9/08* (2006.01)
*G03G 9/09* (2006.01)

(52) U.S. Cl.
CPC ..... *G03G 9/0821* (2013.01); *G03G 9/0825* (2013.01); *G03G 9/08711* (2013.01);
(Continued)

(58) Field of Classification Search
CPC ..... G03G 9/08782; G03G 9/08755; G03G 9/0825
See application file for complete search history.

(56) References Cited

U.S. PATENT DOCUMENTS 6,703,176 B2 3/2004 Naka et al.
6,803,164 B2 10/2004 Mizoo et al.
(Continued)

FOREIGN PATENT DOCUMENTS

JP 3589451 B2 11/2004
JP 2014-089263 A 5/2014
(Continued)

OTHER PUBLICATIONS

Translation of JP 2015-118177 published Jun. 2015.*
(Continued)

*Primary Examiner* — Peter L Vajda
(74) *Attorney, Agent, or Firm* — Fitzpatrick Cella Harper and Scinto

(57) ABSTRACT

Provided is a toner including a binder resin, a colorant, a crystalline polyester, and a release agent, wherein a cross-sectional image of the toner is observed using a scanning transmission electron microscope, domains of the crystalline polyester are present in the cross-sectional image of the toner, the domains have a number-average major diameter of at least 50 nm and not more than 300 nm, the number of the domains is at least 8 and not more than 500, and the domains are present at least 60 number % and not more than 100 number % from an outline of the cross-sectional image to 25% of the distance between the outline and the centroid of the cross-sectional image.

8 Claims, 3 Drawing Sheets

(52) U.S. Cl.
CPC ..... *G03G 9/08755* (2013.01); *G03G 9/08782* (2013.01); *G03G 9/08795* (2013.01); *G03G 9/08797* (2013.01); *G03G 9/0926* (2013.01)

(56) References Cited

U.S. PATENT DOCUMENTS

| | | | |
|---|---|---|---|
| 6,890,695 | B2 | 5/2005 | Shirai et al. |
| 6,953,646 | B2 | 10/2005 | Doujo et al. |
| 7,123,862 | B2 | 10/2006 | Hasegawa et al. |
| 7,160,660 | B2 | 1/2007 | Dojo et al. |
| 7,368,211 | B2 | 5/2008 | Hasegawa et al. |
| 7,470,494 | B2 | 12/2008 | Nishiyama et al. |
| 7,582,401 | B2 | 9/2009 | Ogawa et al. |
| 7,678,523 | B2 | 3/2010 | Hiroko et al. |
| 7,678,524 | B2 | 3/2010 | Hasegawa et al. |
| 7,704,659 | B2 | 4/2010 | Ogawa et al. |
| 7,811,734 | B2 | 10/2010 | Ogawa et al. |
| 7,923,190 | B2 | 4/2011 | Magome et al. |
| 7,935,467 | B2 | 5/2011 | Dojo et al. |
| 7,939,231 | B2 | 5/2011 | Ogawa et al. |
| 8,084,174 | B2 | 12/2011 | Hasegawa et al. |
| 8,124,306 | B2 | 2/2012 | Hirata et al. |
| 8,227,162 | B2 | 7/2012 | Sano et al. |
| 8,426,091 | B2 | 4/2013 | Magome et al. |
| 8,426,094 | B2 | 4/2013 | Magome et al. |
| 8,518,620 | B2 | 8/2013 | Dojo et al. |
| 8,614,044 | B2 | 12/2013 | Matsui et al. |
| 8,778,585 | B2 | 7/2014 | Matsui et al. |
| 8,841,054 | B2 | 9/2014 | Dojo et al. |
| 8,883,389 | B2 | 11/2014 | Matsui et al. |
| 8,918,035 | B2 | 12/2014 | Hasegawa et al. |
| 9,029,055 | B2 | 5/2015 | Aoki et al. |
| 9,097,997 | B2 | 8/2015 | Nomura et al. |
| 9,152,065 | B2 | 10/2015 | Sano et al. |
| 9,213,250 | B2 | 12/2015 | Nomura et al. |
| 9,213,251 | B2 | 12/2015 | Ohmori et al. |
| 9,217,943 | B2 | 12/2015 | Matsui et al. |
| 9,235,151 | B2 | 1/2016 | Tanaka et al. |
| 9,239,528 | B2 | 1/2016 | Hasegawa et al. |
| 9,244,371 | B2 | 1/2016 | Suzumura et al. |
| 9,304,422 | B2 | 4/2016 | Matsui et al. |
| 9,348,246 | B2 | 5/2016 | Magome et al. |
| 9,354,545 | B2 | 5/2016 | Matsui et al. |
| 9,377,708 | B2 | 6/2016 | Magome et al. |
| 9,417,542 | B2 | 8/2016 | Hiroko et al. |
| 9,423,710 | B2 | 8/2016 | Magome et al. |
| 9,423,711 | B2 | 8/2016 | Uratani et al. |
| 9,442,416 | B2 | 9/2016 | Magome et al. |
| 9,454,096 | B2 | 9/2016 | Hasegawa et al. |
| 2004/0265721 | A1* | 12/2004 | Matsuoka ..... G03G 9/08755 430/109.4 |
| 2009/0197192 | A1 | 8/2009 | Hiroko et al. |
| 2011/0151368 | A1* | 6/2011 | Hong ..... G03G 9/0819 430/108.8 |
| 2012/0045717 | A1 | 2/2012 | Hiroko et al. |
| 2014/0348550 | A1* | 11/2014 | Nagayama ..... G03G 15/0839 399/262 |
| 2015/0185658 | A1 | 7/2015 | Wakabayashi et al. |
| 2015/0227067 | A1 | 8/2015 | Hasegawa et al. |
| 2015/0227068 | A1 | 8/2015 | Sano et al. |
| 2015/0253686 | A1* | 9/2015 | Miyakoshi ..... G03G 9/08755 430/109.4 |
| 2016/0139521 | A1 | 5/2016 | Tsuda et al. |
| 2016/0154331 | A1 | 6/2016 | Tanaka et al. |
| 2016/0266509 | A1 | 9/2016 | Sane et al. |

FOREIGN PATENT DOCUMENTS

| | | | | |
|---|---|---|---|---|
| JP | 2015-045719 | | 3/2015 | |
| JP | 2015-118177 | * | 6/2015 | ..... G03G 9/083 |

OTHER PUBLICATIONS

ATR—Theory and Applications, published by Pike and available at http://mmrc.caltech.edu/FTIR/Pike/Intro%20to%20ATR.pdf.*
U.S. Appl. No. 15/191,707, filed Jun. 24, 2016, Satoshi Arimura.
U.S. Appl. No. 15/256,780, filed Sep. 6, 2016, Yusuke Hasegawa.
U.S. Appl. No. 15/259,114, filed Sep. 8, 2016, Yoshitaka Suzumura.
U.S. Appl. No. 15/333,297, filed Oct. 25, 2016, Shiro Kuroki.

* cited by examiner

TONER

BACKGROUND OF THE INVENTION

Field of the Invention

The present invention relates to a toner suitable for electrophotography, electrostatic recording, and magnetic recording.

Description of the Related Art

As a variety of intended applications and usage environments of image forming apparatuses, such as copiers and printers, has been increasing in recent years, an additional demand has been created for energy saving performance, high speed, high image quality, and suitability for widespread use.

As for the properties required from a toner to ensure energy saving performance, the toner needs to be easily melt-deformable at a low temperature.

From the standpoint of widespread use, adaptability to various types of media is required. More specifically, the image forming apparatuses need to be adaptable to media that are thinner than the conventional media, and also to media that are less in surface area than B5 which is generally used.

Where a toner is easily melt-deformed at a low temperature, the viscosity of the toner becomes too low at a high temperature and the toner cannot be retained at the media. The resulting problem is the so-called hot offset, that is, staining of the media with the toner that has adhered to a fixing unit.

A spread between the temperature at which a low-temperature fixability is good and causes no problems in use and the temperature at which a hot offset resistance is good and causes no problems in use is called a fixing width. Here, in general, for a toner with an increased low-temperature fixability, the fixing width does not change unless measures are taken to improve the hot offset resistance.

Meanwhile, where media which are thinner than the conventional media are used, since the heat of the fixing unit is hardly absorbed by the media, the amount of heat received by the toner becomes larger than that in the case of thick media. Likewise, where media of a small surface area are used, since the heat of the fixing unit is not absorbed by the media, the amount of heat received by the toner becomes large. Thus, where an attempt is made to improve energy saving performance and adaptability to a wide variety of media at the same time, it is necessary to improve both the low-temperature fixability and the hot offset resistance and enlarge the fixing width.

In recent years, research and development relating to crystalline polyesters that can melt instantaneously at a melting point, thereby decreasing the melt viscosity of the toner, have been conducted at an amazing rate in order to improve the low-temperature fixability. Some of them have resulted in inventions in which the decrease in the melt viscosity of the entire toner is facilitated by controlling the state in which domains of a crystalline polyester of a fine size are dispersed in the toner (referred to hereinbelow as fine dispersing).

In Japanese Patent No. 3589451, the diameter of dispersed domains of a crystalline polyester is specified.

Japanese Patent Application Publication No. 2014-89263 indicates that fine dispersing of a specific microcrystalline wax and/or ester wax in base particles can be performed more reliably by controlling the diameter of dispersed particle of a crystalline polyester.

However, there is still room for investigation aimed at increasing both the low-temperature fixability and the hot offset resistance and enlarging the fixing width, as mentioned hereinabove.

SUMMARY OF THE INVENTION

The present invention provides a toner that can resolve the above-described problems. More specifically, the present invention provides a toner in which both the low-temperature fixability and the hot offset resistance are improved and the fixing width is enlarged.

The inventors have found that the problems can be resolved by controlling the diameter of domains of the crystalline polyester in the toner and controlling the position where the domains of the crystalline polyester are present. This finding led to the creation of the present invention.

Thus, the present invention provides a toner including a binder resin, a colorant, a crystalline polyester, and a release agent, wherein when a cross-sectional image of the toner is observed using a scanning transmission electron microscope, domains of the crystalline polyester are present in the cross-sectional image of the toner, the domains have a number-average major diameter of at least 50 nm and not more than 300 nm, the number of the domains is at least 8 and not more than 500, and a ratio of the domains present in an area from an outline of the cross-sectional image to 25% of a distance between the outline and a centroid of the cross-sectional image, to a total number of the domains present in the cross-sectional image of the toner is at least 60 number % and not more than 100 number %.

Further features of the present invention will become apparent from the following description of exemplary embodiments (with reference to the attached drawings).

DESCRIPTION OF THE EMBODIMENTS

Figure 1:
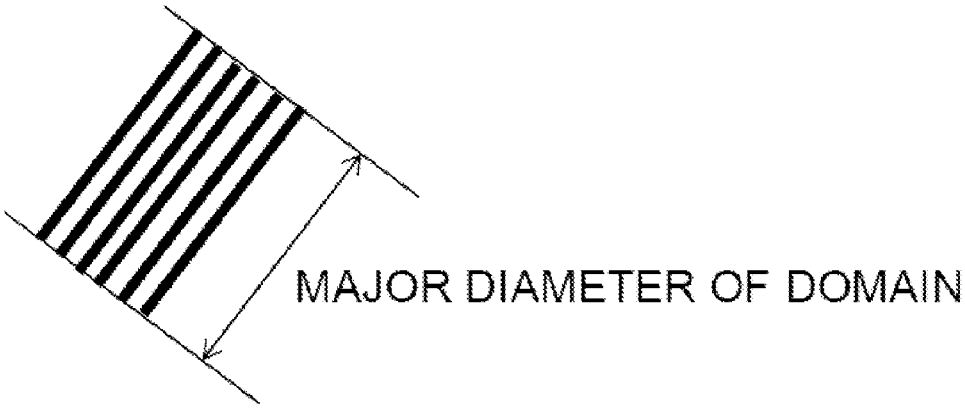
FIG. 1 illustrates the shape of domains.

The toner according to the invention includes a binder resin, a colorant, a crystalline polyester, and a release agent, wherein when a cross-sectional image of the toner is observed using a scanning transmission electron microscope, domains of the crystalline polyester are present in the cross-sectional image of the toner, the domains have a number-average major diameter of at least 50 nm and not more than 300 nm, and the number of the domains is at least 8 and not more than 500, and a ratio of the domains present in an area from an outline of the cross-sectional image to 25% of a distance between the outline and a centroid of the cross-sectional image, to a total number of the domains present in the cross-sectional image of the toner is at least 60 number % and not more than 100 number %.

In the present invention lamellas of a stained crystalline polyester can be observed by staining the cross section of a toner with ruthenium and observing using a scanning transmission electron microscope (STEM).

One shape constituting the lamella is called a domain. Thus, in the present invention, domains of the crystalline polyester are formed in the toner as a plurality of comparatively small domains such as the aforementioned shape. The state in which the domains are thus present inside the toner is described as "domains are dispersed". When the melting point of the crystalline polyester is exceeded as a result of the toner receiving the heat from a fixing unit, the domains dispersed inside the toner are instantaneously softened, and since the domains are dispersed, the toner as a whole is easily softened and the low-temperature fixability thereof is greatly increased.

Meanwhile, where the domains of the crystalline polyester are dispersed in the toner, in particular, where the domains of the crystalline polyester are also present close to the center of the toner, the toner is easily softened more than necessary at the time of fixing. At this time, the viscosity of the toner becomes unnecessarily low, part of the toner adheres to the fixing unit, and hot offset is easily generated. Thus, when the domains of the crystalline polyester are dispersed through the entire toner, as in the related art, low-temperature fixability is improved, but it results in the occurrence of hot offset and the fixing width is not enlarged.

Incidentally, the inventors have found that the occurrence of hot offset can be suppressed, while maintaining the improved low-temperature fixability, by controlling the domains of the crystalline polyester such that no domains are present close to the center of the toner.

According to the investigation conducted by the inventors, in order to improve the low-temperature fixability of the toner and also suppress the hot offset, it is important that the domains of the crystalline polyester be present under specific conditions in an area of the cross-sectional image of the toner from the outline of the cross-sectional image to 25% of the distance between the outline and the centroid of the cross-sectional image.

By so controlling the presence locations and presence ratio of the crystalline polyester domains in the cross-sectional image of the toner, it is possible to improve both the low-temperature fixability and the hot offset resistance and further enlarge the fixing width.

In the present invention, the domains of the crystalline polyester in the cross-sectional image of the toner have a number-average major diameter of at least 50 nm and not more than 300 nm, and preferably at least 100 nm and not more than 200 nm.

FIG. 1 is a schematic diagram of the domains of a crystalline polyester observed in the cross-sectional image of a toner. Where the number-average major diameter of the domains is within the abovementioned ranges, when the crystalline polyester melts instantaneously, the melt deformation amount of the toner increases and the low-temperature fixability can be improved.

Where the number-average major diameter of the domains is less than 50 nm, although the low-temperature fixability is improved, the hot offset resistance is degraded and the fixing width is reduced.

Meanwhile, where the number-average major diameter of the domains is greater than 300 nm, the low-temperature fixability is degraded and the fixing width is reduced.

In the present invention, the number of the domains of the crystalline polyester in the cross-sectional image of the toner is at least 8 and not more than 500, and preferably at least 60 and not more than 500.

Where the number of the domains is greater than 500, although the low-temperature fixability is improved, the hot offset resistance is degraded and the fixing width is reduced.

Meanwhile, where the number of the domains is less than 8, the low-temperature fixability is degraded and the fixing width is reduced.

In the present invention, the domains of the crystalline polyester are present in the area from the outline of the cross-sectional image of the toner to 25% of the distance between the outline and the centroid of the cross-sectional image at least 60 number % and not more than 100 number %, and preferably at least 70 number % and not more than 100 number %.

Figure 2:
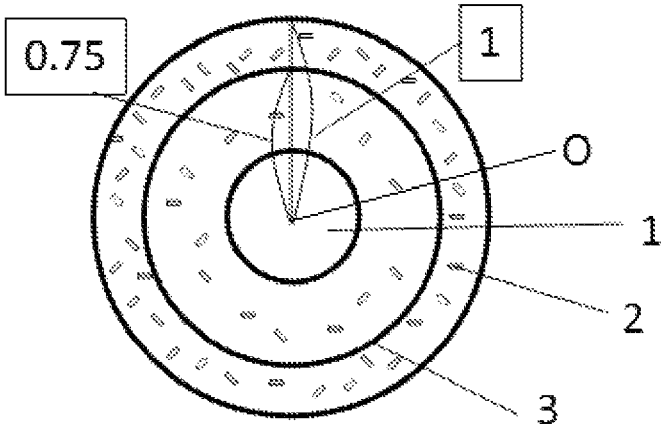
FIG. 2 illustrates the presence state of domains in the cross-sectional image of a toner.

Concerning the presence ratio of the domains, as depicted in FIG. 2, the domains are present at least 60 number %, on the basis of the total number of domains present in the cross-sectional image of the toner, in the area from the outline of the cross-sectional image of the toner to 25% of the distance between the outline and the centroid of the cross-sectional image. In FIG. 2, the reference numeral 1 denotes a domain of a release agent, 2 denotes a domain of a crystalline polyester, 3 denotes a boundary line at 25% of the distance between the outline and the centroid of the cross-sectional image from the outline of the cross-sectional image, and O denotes a centroid of the cross-sectional image. The area from the outline of the cross-sectional image of the toner to 25% of the distance between the outline and the centroid of the cross-sectional image is an area between the outline of the cross-sectional image of the toner and the boundary line 3 in FIG. 2.

The technical meaning of the presence ratio of the domains is described hereinbelow.

(1) As a result of at least 60 number % of the domains being present close to the outline (close to the toner surface) of the cross-sectional image of the toner, the amount of crystalline polyester domains which is effective for the low-temperature fixability is ensured.

(2) Since the domains are unlikely to be present close to the centroid of the cross-sectional image of the toner, the presence amount of the domains that degrade the hot offset resistance is reduced.

The combination of those factors can greatly enlarge the fixing width.

Where the presence ratio of the domains is less than 60 number %, the hot offset resistance is degraded and the fixing width is narrowed. In the present invention, the presence ratio (number %) of the crystalline polyester domains will be referred to hereinbelow as "25% ratio".

In the present invention, it is preferred that domains of a release agent be present in the cross-sectional image of the toner. The ratio of the total area of the domains of the release agent to the area of the cross-sectional image is preferably at least 5.0 area % and not more than 30.0 area %, and more preferably at least 10.0 area % and not more than 25.0 area %.

It is preferred that a ratio of the toner at which the domains of the release agent are present in the centroid of the cross-sectional image of the toner be at least 80 number % and not more than 100 number % of the toner, and more preferably at least 90 number % and not more than 100 number % of the toner.

It is preferred that the domains of the release agent be present in the centroid of the cross-sectional image of the toner, as depicted in FIG. 2. This is because when the toner is excessively melted and deformed during fixing, the release agent elutes from the toner and the hot offset generated by the adhesion of the toner to the fixing unit can be further suppressed.

The melt deformation of the toner caused by the release agent further accelerates the melt deformation of the toner caused by the crystalline polyester and can further improve the low-temperature fixability of the toner.

As described hereinabove, the fixing width can be enlarged by dispersing the domains of the crystalline polyester close to the outline of the cross-sectional image of the toner. However, as a result of the domains of the release agent being present in the centroid of the cross-sectional image of the toner, the low-temperature fixability and the hot offset resistance can be further improved and the fixing width can be further enlarged.

In the present invention, as a result of the ratio of the total area of the domains of the release agent to the area of the cross-sectional image being within the above-described range, the low-temperature fixability is improved, the hot offset resistance can be further improved, and the fixing width can be further enlarged.

Further, in the present invention, it is preferred that the domains of the release agent be present in the centroid of the cross-sectional image of the toner in at least 80 number % of the toner. As a result of the domains of the release agent being present in the centroid of the cross-sectional image of the toner in a large number of toner particles, the effects of the present invention can be easily obtained.

In the present invention, the ratio (number %) of the toner in which the domains of the release agent are present in the centroid of the cross-sectional image of the toner will be referred to hereinbelow as "center point ratio".

In the present invention, the crystalline polyester is not particularly limited, and well-known crystalline polyesters can be used. It is, however, preferred that the crystalline polyester be a polycondensate of an aliphatic dicarboxylic acids and an aliphatic diol.

A polycondensate of a straight-chain aliphatic dicarboxylic acids represented by Formula (1) below and a straight-chain aliphatic diol represented by Formula (2) below is more preferred.

In the present invention, the crystallinity of the crystalline polyester indicates that a clear endothermic peak (melting point) is observed at a reversible specific heat variation curve obtained in specific heat variation measurements using a differential scanning colorimeter.

$$HOOC—(CH_2)_n—COOH \quad \text{Formula (1)}$$

(in Formula (1), m is an integer of at least 4 and not more than 14 (preferably at least 6 and not more than 12));

$$HO—(CH_2)_n—OH \quad \text{Formula (2)}$$

(in Formula (2), n is an integer of at least 4 and not more than 16 (preferably at least 6 and not more than 12)).

In the present invention, the crystalline polyester may also have as a constituent component an aliphatic dicarboxylic acid other than the straight-chain aliphatic dicarboxylic acid represented by Formula (1).

Examples of the aliphatic dicarboxylic acid include oxalic acid, malonic acid, succinic acid, glutaric acid, glutaconic acid, maleic acid, fumaric acid, mesaconic acid, citraconic acid, itaconic acid, isophthalic acid, terephthalic acid, n-dodecylsuccinic acid, n-dodecenylsuccinic acid, cyclohexanedicarboxylic acid, and anhydrides and lower alkyl esters of these acids.

The crystalline polyester may also have as a constituent component an aliphatic diol other than the straight-chain aliphatic diol represented by Formula (2). Examples of the aliphatic diol include ethylene glycol, diethylene glycol, triethylene glycol, 1,2-propylene glycol, 1,3-propylene glycol, dipropylene glycol, trimethylene glycol, neopentyl glycol, and 1,4-butadiene glycol.

Examples of alcohols that may be used in addition to the abovementioned aliphatic diols include dihydric alcohols such as polyoxyethylenated bisphenol A, polyoxypropylenated bisphenol A, and 1,4-cyclohexane dimethanol, aromatic alcohols such as 1,3,5-trihydroxymethylbenzene, and trihydric and higher alcohols such as pentaerythritol, dipentaerythritol, tripentaerythritol, 1,2,4-butanetriol, 1,2,5-pentanetriol, glycerin, 2-methylpropane triol, 2-methyl-1,2,4-butanetriol, trimethylolethane, and trimethylol propane.

These monomers may be used individually or in combinations of two or more thereof.

From the standpoint of crystallinity of the crystalline polyester, the amount of the straight-chain aliphatic dicarboxylic acid represented by Formula (1) in the total amount of carboxylic acid components is preferably at least 80 mol % and not more than 100 mol %, more preferably at least 90 mol % and not more than 100 mol %, and even more preferably 100 mol %.

Further, from the standpoint of crystallinity of the crystalline polyester, the amount of the straight-chain aliphatic diol represented by Formula (2) in the total amount of alcohol components is preferably at least 80 mol % and not more than 100 mol %, more preferably at least 90 mol % and not more than 100 mol %, and even more preferably 100 mol %.

Where the constituent components of the crystalline polyester are of a straight-chain configuration, as indicated hereinabove, the polyester resin excels in crystallinity and has an appropriate melting point. As a result, the toner excels in heat-resistant storage stability and low-temperature fixability.

Further, where m in Formula (1) and n in Formula (2) are each at least 4, the melting point (Tm) is appropriate. Therefore, the toner excels in heat-resistant storage stability and low-temperature fixability. Where m in Formula (1) is not more than 14 and n in Formula (2) is not more than 16, materials suitable for practical use can be easily obtained.

If necessary, a monovalent acid such as acetic acid and benzoic acid, or a monohydric alcohol such as cyclohexanol benzyl alcohol may be used with the object of adjusting the acid value or hydroxyl value.

In the present invention, it is further preferred that the crystalline polyester be a saturated polyester. This is because no crosslinking reaction occurs in the reaction of the saturated crystalline polyester with a peroxide-based polymerization initiator, by contrast with the crystalline polyester having an unsaturated portion, and therefore the saturated crystalline polyester is advantageous in terms of solubility.

The crystalline polyester can be produced by the usual polyester synthesis method.

For example, the crystalline polyester can be obtained by performing an esterification reaction or a transesterification reaction of a dicarboxylic acid component and a dialcohol component, and then conducting a condensation polymerization reaction in the conventional manner under a reduced pressure or by introducing nitrogen gas.

During the esterification reaction or transesterification reaction, the usual esterification catalyst or transesterification catalyst such as sulfuric acid, tertiary butyl titanium butoxide, dibutyltin oxide, manganese acetate, and magnesium acetate can be used as necessary.

With respect to the condensation polymerization, the usual polymerization catalysts, for example, well-known catalysts such as tertiary butyl titanium butoxide, dibutyltin oxide, tin acetate, zinc acetate, tin disulfide, antimony trioxide, and germanium dioxide can be used. The polymerization temperature and the amount of the catalyst are not particularly limited and can be arbitrarily selected as required.

It is preferred that a titanium catalyst be used as the catalyst, and a chelate-type titanium catalyst is more preferred. This is because titanium catalysts have suitable reactivity and a polyester of a molecular weight distribution desirable in the present invention can be obtained. Another reason why the crystalline polyester produced by using a titanium catalyst is superior is that titanium or a titanium catalyst taken into the polyester in the production process advances the charging performance of the toner.

Chelate-type titanium catalysts are preferred because the aforementioned effects are strong and also because the catalyst hydrolyzed in the reaction is taken into the polyester, thereby enabling adequate control of the hydrogen abstraction reaction from the peroxide-based polymerization initiator. Yet another reason is that the durability of the toner is improved.

Further, the acid value of the crystalline polyester can be controlled by blocking the end carboxyl group or hydroxyl group of the crystalline polyester. A monocarboxylic acid and a monoalcohol can be used for blocking the end group. Examples of the monocarboxylic acid include benzoic acid, naphthalenecarboxylic acid, salicylic acid, 4-methylbenzoic acid, 3-methylbenzoic acid, phenoxyacetic acid, biphenylcarboxylic acid, acetic acid, propionic acid, butyric acid, octanoic acid, decanoic acid, dodecanoic acid, and stearic acid. Examples of suitable monoalcohols include methanol, ethanol, propanol, isopropanol, butanol, and higher alcohols.

In the present invention, the weight-average molecular weight (Mw) of the crystalline polyester is preferably at least 6000 and not more than 80,000, and more preferably at least 8000 and not more than 40,000.

Where the weight-average molecular weight (Mw) is at least 6000 and not more than 80,000, it is possible to obtain promptly the plasticizing effect of the crystalline polyester in the fixing step, while maintaining a high degree of crystallization of the crystalline polyester in the toner production process. As a result, excellent heat-resistant storage stability as well as excellent fixing performance under low-temperature conditions or high-speed conditions can be obtained.

The weight-average molecular weight (Mw) of the crystalline polyester can be controlled by a variety of production conditions of the crystalline polyester. The weight-average molecular weight (Mw) of the crystalline polyester can be measured by using gel permeation chromatography (GPC).

The acid value of the crystalline polyester is preferably at least 0.5 mg KOH/g and not more than 5.0 mg KOH/g, and more preferably at least 0.8 mg KOH/g and not more than 4.0 mg KOH/g.

For example, when the suspension polymerization method in which the toner is produced in an aqueous medium is used as a method for producing the toner, the presence ratio (25% ratio) of the crystalline polyester domains can be increased by controlling the acid value of the crystalline polyester to the above-described range.

In this case, where the acid value is higher than 5.0 mg KOH/g, the crystalline polyester tends to precipitate on the toner surface and the developing performance tends to degrade.

Meanwhile, where the acid value is less than 0.5 mg KOH/g, the 25% ratio tends to decrease, the domains of the crystalline polyester are likely to be present close to the centroid of the cross-sectional image of the toner, and the hot offset resistance tends to degrade.

In the present invention, the amount of the crystalline polyester is preferably at least 1 part by mass and not more than 15 parts by mass, more preferably at least 2 parts by mass and not more than 10 parts by mass, and even more preferably at least 2 parts by mass and not more than 7 parts by mass, per 100 parts by mass of the binder resin.

The toner in accordance with the present invention preferably includes two or more release agents. In particular, when the suspension polymerization method is used as the method for producing the toner, it is preferred that two or more release agents be included.

The total amount of the release agents in the toner is preferably at least 2.5 parts by mass and not more than 35.0 parts by mass, more preferably at least 4.0 parts by mass and not more than 30.0 parts by mass, and even more preferably at least 6.0 parts by mass and not more than 25.0 parts by mass, per 100 parts by mass of the binder resin.

Examples of the release agents are presented below.

Aliphatic hydrocarbon waxes such as low-molecular-weight polyethylene, low-molecular-weight polypropylene, microcrystalline wax, Fischer-Tropsch waxes, and paraffin waxes; oxides of aliphatic hydrocarbon waxes such as oxidized polyethylene wax, or block copolymers thereof; waxes mainly composed of fatty esters such as carnauba wax and montanic acid ester wax, and partially or entirely deoxidized fatty acid esters such as deoxidized carnauba wax; saturated straight-chain fatty acids such as palmitic acid, stearic acid, and montanic acid; unsaturated fatty acids such as brassidic acid, eleostearic acid, and parinaric acid; saturated alcohols such as stearyl alcohol, aralkyl alcohol, behenyl alcohol, carnaubyl alcohol, ceryl alcohol, and melissyl alcohol; polyhydric alcohols such as sorbitol; fatty acid amides such as linoleic acid amide, oleic acid amide, and lauric acid amide; saturated fatty acid bisamides such as methylene bis-stearic acid amide, ethylene bis-capric acid amide, ethylene bis-lauric acid amide, and hexamethylene bis-stearic acid amide; unsaturated fatty acid amides such as ethylene bis-oleic acid amide, hexamethylene bis-oleic acid amide, N,N'-dioleyladipic acid amide, and N,N'-dioleylsebacic acid amide; aromatic bisamides such as m-xylene bis-stearic acid amide and N,N'-distearylisophthalic acid amide; aliphatic metal salts (commonly called "metal soaps") such as calcium stearate, calcium laurate, zinc stearate, and magnesium stearate; waxes obtained by using and grafting a vinyl monomer such as styrene or acrylic acid onto aliphatic hydrocarbon waxes; partial esters of fatty acids with polyhydric alcohols, such as behenic acid monoglyceride; and methyl ester compounds having a hydroxy group which are obtained by hydrogenation of vegetable oils and fats.

For example, when the suspension polymerization method in which the toner is produced in an aqueous medium is used as a method for producing the toner, it is preferred that at least one of the release agents used be compatible with the binder resin. It is also preferred that at least one other release agent be hardly compatible with the binder resin.

As a result of using a release agent easily compatible with the binder resin, the presence state (the number-average major diameter and the number of the domains) of the domains of the crystalline polyester can be easily controlled to the desired state. The preferred examples of the release agents that are suitable for attaining this objective include waxes based on fatty acid esters, such as carnauba wax and montanic acid ester wax, and ester waxes obtained by partial or complete deoxidation of fatty acid esters, such as deoxidized carnauba wax.

The following mechanism can be considered to explain why the presence state (the number-average major diameter and the number of the domains) of the crystalline polyester can be easily controlled to the range of the present invention. After the release agent has been compatilibized with the binder resin of the toner, crystal nuclei of the release agent are formed in the enter binder resin by crystallization. A state with the domains of the crystalline polyester being dispersed in the entire toner can thereafter be obtained as a result of crystallization of the crystalline polyester at the crystal nuclei as starting points.

The release agent that is, as mentioned hereinabove, easily compatible with the binder resin, among the release agents, is preferably an ester wax because the degree of crystallization of the crystalline polyester can be increased and the presence state can be easily controlled as desired.

It is also preferred that the ester wax be an ester compound of a dihydric alcohol and an aliphatic monocarboxylic acid, or an ester compound of a divalent carboxylic acid and an aliphatic monoalcohol (can be referred to hereinbelow as a bifunctional ester wax). Where one ester bond is present in one molecule of the ester compound, the "monofunctional" expression is used, and when n ester bonds are present, the "n-functional" expression is used.

It is further preferred that the ester wax be a bifunctional ester wax represented by Formula (3) or Formula (4) below.

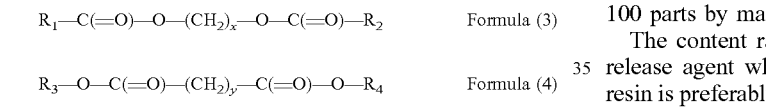

$$R_1—C(=O)—O—(CH_2)_x—O—C(=O)—R_2 \quad \text{Formula (3)}$$

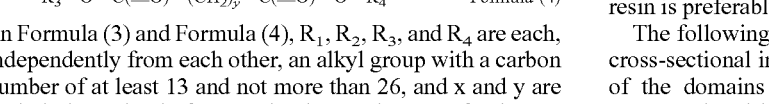

$$R_3—O—C(=O)—(CH_2)_y—C(=O)—O—R_4 \quad \text{Formula (4)}$$

(in Formula (3) and Formula (4), $R_1$, $R_2$, $R_3$, and $R_4$ are each, independently from each other, an alkyl group with a carbon number of at least 13 and not more than 26, and x and y are each, independently from each other, an integer of at least 4 and not more than 18 (preferably, at least 8 and not more than 10)).

For example, in the suspension polymerization method, the bifunctional ester wax readily acts as a nucleating agent for the crystalline polyester, facilitates the crystallization of the domains of the crystalline polyester inside the toner, and enables easy control of the domains to the desired state.

More specifically, the number-average major diameter of the domains of the crystalline polyester can be easily controlled to a comparatively narrow range of at least 50 nm and not more than 300 nm, and the number of the domains of the crystalline polyester can be easily controlled to a comparatively wide range of at least 8 and not more than 500.

Specific examples of the divalent carboxylic acids include decanedioic acid (sebacic acid) and dodecanedioic acid. Examples of the dihydric alcohols include 1,8-octanediol, 1,9-nonanediol, and 1,10-decanediol. Here, straight-chain carboxylic acids and straight-chain alcohols are exemplified, but they may also have a branched structure.

Specific examples of the aliphatic monocarboxylic acids and aliphatic monoalcohols are presented below.

Thus, examples of the aliphatic monocarboxylic acids include myristic acid, palmitic acid, margaric acid, stearic acid, tuberculostearic acid, arachidic acid, behenic acid, lignoceric acid, and cerotic acid.

Examples of the aliphatic monoalcohols include tetradecanol, pentadecanol, hexadecanol, heptadecanol, octadecanol, nonadecanol, eicosanol, docosanol, tricosanol, tetracosanol, pentacosanol, and hexacosanol.

The amount of the bifunctional ester wax is preferably at least 1 part by mass and not more than 20 parts by mass, more preferably at least 1 part by mass and not more than 15 parts by mass, and even more preferably at least 3 parts by mass and not more than 8 parts by mass, per 100 parts by mass of the binder resin.

The release agent which is hardly compatible with the binder resin easily forms the domains of the release agent which are phase-separated from the binder resin inside the toner. Further, as a result of intentionally ensuring the presence of the domains of such a release agent close to the centroid of the cross-sectional image of the toner, the domains of the crystalline polyester are relatively easily localized close to the toner surface. As a result, the presence ratio (25% ratio) of the domains of the crystalline polyester is easily controlled to the abovementioned range.

Specific examples of such release agent include aliphatic hydrocarbon waxes such as low-molecular-weight polyethylene, low-molecular-weight polypropylene, microcrystalline wax, Fischer-Tropsch waxes, and paraffin waxes. The aliphatic hydrocarbon waxes may be modified, for example, by adding a hydroxyl group. Further, the acid value of the release agent is preferably at least 0.0 mg KOH/g and not more than 20.0 mg KOH/g, and more preferably at least 0.05 mg KOH/g and not more than 10.0 mg KOH/g.

The amount of the release agent which is hardly compatible with the binder resin is preferably at least 1 part by mass and not more than 30 parts by mass, and more preferably at least 3 parts by mass and not more than 20 parts by mass, per 100 parts by mass of the binder resin.

The content ratio of the bifunctional ester wax and the release agent which is hardly compatible with the binder resin is preferably 2:8 to 8:2, and more preferably 3:7 to 7:3.

The following method can be used for controlling, in the cross-sectional image of the toner, the ratio of the total area of the domains of the release agent to the area of the cross-sectional image to at least 5.0 area % and not more than 30.0 area %.

When the release agent hardly compatible with the binder resin is used, the domains of the release agent are easily formed. By changing the amount of the release agent, the ratio of the total area of the domains of the release agent can be controlled to the above-described range. Further, by controlling the acid value of the release agent to a low value, it is possible to increase the ratio of the toner (center point ratio) in which the domains of the release agent are present in the centroid of the cross-sectional image of the toner.

In order to control the center point ratio to at least 80 number %, it is preferred that an aliphatic hydrocarbon wax be used that has not been subjected to modification.

In the present invention, the toner includes a colorant. The below-described black, yellow, magenta and cyan pigments and, optionally, dyes can be used as the colorants. A magnetic body can be used as a black colorant.

Well-known yellow colorants can be used.

Examples of suitable pigment-based yellow colorants include compounds exemplified by condensed polycyclic pigments, isoindolinone compounds, anthraquinone compounds, azo metal complexes, methine compounds, and allylamide compounds. Specific examples include C.I. Pigment Yellow 3, 7, 10, 12, 13, 14, 15, 17, 23, 24, 60, 62, 74, 75, 83, 93, 94, 95, 99, 100, 101, 104, 108, 109, 110, 111, 117, 123, 128, 129, 138, 139, 147, 148, 150, 155, 166, 168, 169, 177, 179, 180, 181, 183, 185, 191:1, 191, 192, 193, and 199.

Examples of dye-based yellow colorants include C.I. Solvent Yellow 33, 56, 79, 82, 93, 112, 162, 163, C.I. Disperse Yellow 42, 64, 201, and 211.

Well-known magenta colorant can be used.

Examples of magenta colorants include condensed polycyclic pigments, diketopyrrolopyrrole compounds, anthraquinone compounds, quinacridone compounds, basic dye lake compounds, naphthol compounds, benzimidazolone compounds, thioindigo compounds, and perylene compounds. Specific examples include C.I. Pigment Red 2, 3, 5, 6, 7, 23, 48:2, 48:3, 48:4, 57:1, 81:1, 122, 146, 150, 166, 169, 177, 184, 185, 202, 206, 220, 221, 238, 254, 269, and C.I. Pigment Violet 19.

Examples of cyan colorants include phthalocyanine compounds and derivatives thereof, anthraquinone compounds, and basic dye lake compounds. Specific examples include C.I. Pigment Blue 1, 7, 15, 15:1, 15:2, 15:3, 15:4, 60, 62, and 66.

The colorants can be used individually or as a mixture, and also in a state of solid solution. The colorant to be used in the present invention is selected with consideration for the hue angle, chroma, brightness, weather resistance, OHP transparency, and dispersibility in the toner.

The amount of the colorant is preferably at least 1 part by mass and not more than 20 parts by mass per 100 parts by mass of the binder resin.

Well-known black colorants can be used.

For example, carbon black can be used as the black colorant.

Further, the yellow, magenta, and cyan colorants can be mixed to obtain a black color.

Further, a black magnetic body may be used as a black colorant. When a magnetic body is used as the colorant, in order to increase the humidity resistance of the resulting toner, it is preferred that a magnetic body subjected hydrophobization treatment on the surface thereof be used.

Examples of the magnetic bodies include iron oxides such as magnetite, maghemite, and ferrite and also iron oxides including other metal oxides; metals such as Fe, Co, and Ni, alloys of those metals with metals such as Al, Co, Cu, Pb, Mg, Ni, Sn, Zn, Sb, Ca, Mn, Se, and Ti, and mixtures thereof.

Specific examples include triiron tetraoxide ($Fe_3O_4$), ferric oxide ($\gamma$-$Fe_2O_3$), zinc iron oxide ($ZnFe_2O_4$), copper iron oxide ($CuFe_2O_4$), neodymium iron oxide ($NdFe_2O_3$), barium iron oxide ($BaFe_{12}O_{19}$), magnesium iron oxide ($MgFe_2O_4$), and manganese iron oxide ($MnFe_2O_4$).

The BET specific surface area of the magnetic body determined by a nitrogen adsorption method is preferably at least 2.0 $m^2/g$ and not more than 20.0 $m^2/g$, and more preferably at least 3.0 $m^2/g$ and not more than 10.0 $m^2/g$. The shape of the magnetic body can be polyhedral, octahedral, hexahedral, spherical, acicular, and flaky, but from the standpoint of increasing the image density, shapes with a small anisotropy such as polyhedral, octahedral, hexahedral, and spherical are preferred. From the standpoint of uniform dispersibility in the toner and tinge, it is preferred that the volume-average particle diameter (Dv) of the magnetic body be at least 0.10 μm and not more than 0.40 The volume-average particle diameter (Dv) of the magnetic body can be measured using a transmission electron microscope. Specifically, after the toner to be observed has been sufficiently dispersed in an epoxy resin, curing is performed for 2 days in an atmosphere at a temperature of 40° C. The obtained cured product is cut with a microtome into flaky samples, the cross-sectional image is captured at a magnification of 10,000 times to 40,000 times by using a transmission electron microscope (TEM), and the particle diameter of 100 particles of the magnetic body in the cross-sectional image is measured. The number-average particle diameter (D1) is then calculated on the basis of the circle-equivalent diameter equal to the projection area of the magnetic body. The particle diameter may be also measured with an image analysis device.

The magnetic bodies may be used individually or in combinations of two or more thereof.

The amount of the magnetic body is preferably at least 20.0 parts by mass and not more than 150.0 parts by mass, and more preferably at least 50.0 parts by mass and not more than 100.0 parts by mass, per 100 parts by mass of the binder resin.

The amount of the magnetic body can be measured using a thermal analysis device "device name: TGA 7, manufactured by PerkinElmer Co., Ltd.". The measurement method is described below.

The toner is heated from the normal temperature to 900° C. at a rate of temperature rise of 25° C./min under a nitrogen atmosphere. The reduction in mass (%) from 100° C. to 750° C. is taken as the binder resin amount, and the residual mass is taken as the approximate amount of the magnetic body.

In the present invention, where the suspension polymerization method is used to produce the toner in an aqueous medium, hydrophobization of the magnetic body surface with a hydrophobic compound may be used as a means for localizing the magnetic body inside the toner.

In the present invention, the thermal conductivity of the toner is preferably at least 0.210 W/(m·K) and not more than 1.000 W/(m·K), and more preferably at least 0.220 W/(m·K) and not more than 1.000 W/(m·K).

When the suspension polymerization method is used, the thermal conductivity of the resulting toner is easily controlled to at least 0.210 W/(m·K). The reason why the thermal conductivity of the toner can be increased is that the magnetic body hydrophobized with a hydrophilic compound tends to be present inside the droplets of a polymerizable monomer composition including the polymerizable monomer which is formed in the aqueous medium. Further, at a molecular level, since the untreated surface remains in the magnetic bodies, although the magnetic body is present inside the toner, the magnetic body tends to be selectively present close to the toner surface.

Meanwhile, since the thermal conductivity of the magnetic body is high as compared with that of the binder resin, when the toner is produced by the emulsion polymerization method by using the magnetic body subjected to hydrophobization, a toner with a comparatively high thermal conductivity can be obtained. As a result of increasing the thermal conductivity of a toner in which the crystalline polyester is dispersed inside the toner, as in the present invention, the heat of the fixing unit is rapidly transferred to a plurality of toner particles and the low-temperature fixability is further improved.

An effective means for controlling the thermal conductivity of the toner to the abovementioned range is to localize the magnetic body with a high thermal conductivity inside the toner and selectively close to the toner surface.

For example, where the amount of the hydrophobic compound that is used for hydrophobizing the magnetic body is increased in the control of thermal conductivity, the amount of carbon adhered to the magnetic body increases. As a result, thermal conductivity at the time the toner is produced is increased. Conversely, where the amount of the hydrophobic compound is reduced, the thermal conductivity is decreased.

As mentioned hereinabove, the increase in thermal conductivity indicates that the magnetic body is unevenly distributed in large numbers close to the toner surface.

The amount of carbon adhered to the magnetic body is preferably at least 0.30 mass % and not more than 1.00 mass %, and more preferably at least 0.40 mass % and not more than 1.00 mass %.

A method for producing the magnetic body is described below.

Initially, an alkali such as sodium hydroxide is added, in an amount equivalent or at least equivalent to that of the iron component, to an aqueous solution of a ferrous salt to prepare an aqueous solution of ferrous hydroxide. The air is blown into the prepared aqueous solution while maintaining the pH thereof at least 7.0, the oxidation reaction of the ferrous hydroxide is performed while heating the aqueous solution to at least 70° C., and seed crystals serving as the cores of the magnetic iron oxide particles are generated.

Then, an aqueous solution including ferrous sulfate in an amount of about 1 equivalent, as determined on the basis of the previously added amount of the alkali, is added to the slurry including the seed crystals. The reaction of the ferrous hydroxide is advanced while maintaining the pH of the obtained mixture at least 5.0 and not more than 10.0 and blowing the air, and magnetic iron oxide particles are grown on the seed crystals as cores. At this time, the shape and magnetic properties of the magnetic iron oxide can be controlled by selecting, as appropriate, the pH, reaction temperature, and stirring conditions. The pH of the mixture shifts to the acidic side as the oxidation reaction progresses, but it is preferred that the pH of the mixture do not become less than 5.0.

Further, after completion of the oxidation reaction, a silicon source such as sodium silicate is added, the pH of the mixture is adjusted to at least 5.0 and not more than 8.0, and a coating layer of silicon is formed on the surface of the magnetic iron oxide particles. Magnetic iron oxide can be obtained by filtering, washing, and drying the obtained magnetic iron oxide particles by the usual methods.

The amount of silicon element present on the magnetic iron oxide surface can be controlled by adjusting the amount of the silicon source such as sodium silicate which is to be added after the oxidation reaction has ended.

Hydrophobization treatment of the magnetic iron oxide surface is then performed by using a hydrophobic compound such as a silane compound.

When wet hydrophobization treatment is performed, the resulting magnetic iron oxide is redispersed in an aqueous medium, or magnetic iron oxide obtained by washing and filtering is redispersed, without drying, in a separate aqueous medium to prepare a redispersion solution.

The pH of the resulting redispersion solution is adjusted to at least 3.0 and not more than 6.5, an alkoxysilane is gradually charged thereinto, and the magnetic iron oxide is uniformly dispersed using a disper blade or the like.

In this case, it is preferred that the liquid temperature of the dispersion solution be at least 35° C. and not more than 60° C. A lower pH and a higher liquid temperature generally facilitate the hydrolysis of the alkoxysilane.

The hydrophobization treatment of the magnetic iron oxide surface may be also performed by using a hydrophobization compound, such as a silane compound, in a gaseous phase.

In the hydrophobization treatment, the silane compound is adsorbed on the magnetic iron oxide surface by hydrogen bonding, and dehydration thereof forms strong chemical bonds. Since hydrogen bonding of the silane compound and magnetic iron oxide surface is a reversible reaction, a smaller amount of water in the system makes it possible to treat the magnetic iron oxide surface with a larger amount of the silane compound. A higher hydrophobicity of the magnetic iron oxide accelerates the build-up of the toner charge.

Well-known devices can be used for the hydrophobization treatment of the magnetic iron oxide surface. Specific examples of such devices include a Henschel mixer (Mitsui Miike Chemical Engineering Machinery Co., Ltd.), a high-speed mixer (Fukae Powtec Corporation), and a hybridizer (NARA MACHINERY CO., LTD.).

Examples of the silane compounds include those represented by Formula (5) below.

$$R_mSiY_n \qquad \text{Formula (5)}$$

(in Formula (5), R represents an alkoxy group or a hydroxyl group; Y represents an alkyl group, a phenyl group, or a vinyl group; the alkyl group may have an amino group, a hydroxy group, an epoxy group, an acryl group, and a methacryl group as a substituent; m represents an integer of at least 1 and not more than 3; n represents an integer of at least 1 and not more than 3. However, m+n=4).

Examples of the silane compounds include vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, n-hexyltrimethoxysilane, n-octyltrimethoxysilane, n-octyltriethoxysilane, n-decyltrimethoxysilane, hydroxypropyltrimethoxysilane, n-hexadecyltrimethoxysilane, and n-octadecyltrimethoxysilane, and also hydrolysates thereof.

The silane compounds can be used individually or in combinations of a plurality thereof.

When a plurality thereof is used, the treatment may be performed individually with each silane compound or simultaneously.

In the present invention, the binder resin is not particularly limited, and the below-described well-known resins suitable for toners can be used.

Homopolymers of styrene and substitution products thereof such as polystyrene and polyvinyl toluene; styrene copolymers such as styrene-propylene copolymer, styrene-vinyl toluene copolymer, styrene-vinyl naphthalene copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleic acid ester copolymer; styrene-acrylic resins such as styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, and styrene-dimethylaminoethyl methacrylate copolymer; polymethyl methacrylate, polybutyl methacrylate, polyvinyl acetate, polyethylene, polypropylene, polyvinyl butyral, silicone resins, polyester resins, polyamide resins, epoxy resins, and polyacrylic acid resins. These resins can be used individually or in combinations of a plurality thereof. Among them, from the standpoint of developing characteristic and fixing performance, it is preferred that the binder resin include a styrene copolymer, a styrene-acrylic resin, and a polyester resin, more preferably a styrene-acrylic resin.

In the present invention, where the binder resin includes a styrene-acrylic resin, the binder resin can also include, in addition to the styrene-acrylic resin, a well-known resin suitable for a binder resin for a toner, in an amount such that the effects of the present invention are not impaired.

In the present invention, the amount of the styrene-acrylic resin is at least 70 mass % and not more than 100 mass %, and more preferably at least 80 mass % and not more than 100 mass % relative to the total amount of the binder resin.

A method for producing the binder resin is not particularly limited, and a well-known method can be used.

In the present invention, a charge control agent may be compounded to enable the toner to keep stable charging performance regardless of the environment.

Well-known charge control agents can be used, and those that enable a high charging speed and can maintain stably a constant quantity of charge are particularly preferred.

Examples of charge control agents which are capable of charging the toner negatively are presented below.

Monoazo metal compounds, acetylacetone metal compounds, metal compounds of aromatic hydroxycarboxylic acids, aromatic dicarboxylic acids, hydroxycarboxylic acids, and dicarboxylic acids, aromatic hydroxycarboxylic acids, aromatic mono- and polycarboxylic acids, metal salts, anhydrides, and esters thereof, phenol derivatives such as bisphenol, urea derivatives, metal-containing salicylic acid compounds, metal-containing naphthoic acid compounds, boron compounds, quaternary ammonium salts, calixarenes, and resin-based charge control agents.

Examples of charge control agents which are capable of charging the toner positively are presented below.

Nigrosins and nigrosins modified with fatty acid metal salts; guanidine compounds; imidazole compounds; tributylbenzylammonium-1-hydroxy-4-naphthosulfonic acid salts, quaternary ammonium salts such as tetrabutylammonium tetrafluoroborate, onium salts such as phosphonium salts, which are analogs of the quaternary ammonium salts, and lake pigments thereof; triphenylmethane dyes and lake pigments thereof (laking agents include tungstophosphoric acid, molybdophosphoric acid, tungstomolybdophosphoric acid, tannic acid, lauric acid, gallic acid, ferricyanides, and ferrocyanides); metal salts of higher fatty acids; diorganotin oxides such as dibutyltin oxide, dioctyltin oxide, and dicyclohexyltin oxide; diorganotin borates such as dibutyltin borate, dioctyltin borate, and dicyclohexyltin borate; and resin-based charge control agents.

These charge control agents may be used individually or in combinations of two or more thereof.

Among them, other than the resin-based charge control agents, metal-containing salicylic acid compounds are preferred, such compounds in which the metal is aluminum or zirconium are more preferred, and aluminum salicylate compounds are even more preferred.

Among the resin-based charge control agents, polymers or copolymers having a sulfonic acid group, a sulfonic acid salt group or sulfonic acid ester group, a salicylic acid segment, and an aromatic acid segment are preferred.

The amount of the charge control agent is preferably at least 0.01 parts by mass and not more than 20.0 parts by mass, and more preferably at least 0.05 parts by mass and not more than 10.0 parts by mass, per 100.0 parts by mass of the binder resin.

In the present invention, the toner may have a core-shell structure in order to improve further the storage stability and developing performance.

The core-shell structure is a structure in which the surface of a core is covered with a shell layer. The term "covered", as used herein, means that the core surface is wrapped in the shell layer.

Because of the shell layer, the toner tends to have a uniform surface, improved flowability, and also uniform charging performance.

Further, where the core is covered with a shell layer including a resin, the low-melting-point substances are unlikely to exude out even in long-term storage, and storage stability tends to improve.

In the present invention, the shell layer preferably includes an amorphous polyester resin. Where the toner includes a magnetic body, from the standpoint of improving the dispersibility of the magnetic body, it is preferred that the acid value of the amorphous polyester resin be at least 0.1 mg KOH/g and not more than 5.0 mg KOH/g.

A specific procedure for forming the shell layer includes, for example, using the suspension polymerization method, utilizing the hydrophilicity of the amorphous polyester resin constituting the shell layer, and creating uneven distribution of the amorphous polyester resin close to the toner surface.

The shell layer can be also formed by causing a monomer to swell on the core surface and conducting polymerization by the so-called seed polymerization method.

A saturated polyester resin, an unsaturated polyester resin, or a combination thereof can be selected, as appropriate, and used as the amorphous polyester resin. A polycondensate of an alcohol component and a carboxylic acid component can be used as the amorphous polyester resin. Examples of such components are presented below.

Examples of the alcohol component include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, cyclohexanedimethanol, butenediol, octenediol, cyclohexenedimethanol, hydrogenated bisphenol A, derivatives of the bisphenol A represented by Formula (I) below, and diol derivatives represented by Formula (II) below.

(I)

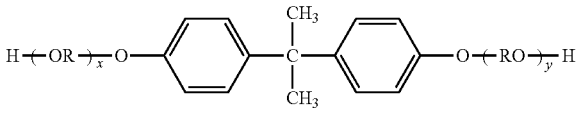

(in the formula, R is an ethylene group or a propylene group; x and y are integers of at least 0, the average value of x+y is at least 0 and not more than 10)

(II)

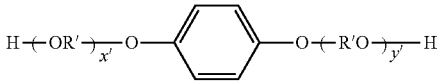

-continued in the formula,

R′ is $-CH_2CH_2-$, $-CH_2-CH(CH_3)-$, or $-CH_2-C(CH_3)_2-$, x′ and y′ are integers of at least 0, and the average value of x′ + y′ is at least 0 and not more than 10

Examples of the divalent carboxylic acids include benzenedicarboxylic acids and anhydrides thereof such as phthalic acid, terephthalic acid, isophthalic acid, and phthalic anhydride; alkyldicarboxylic acids such as succinic acid, adipic acid, sebacic acid, and azelaic acid, and anhydrides thereof; succinic acid substituted with an alkyl group or an alkenyl group with a carbon number of at least 6 and not more than 18, and anhydrides thereof; and unsaturated dicarboxylic acids such as fumaric acid, maleic acid, citraconic acid, and itaconic acid, and anhydrides thereof.

Polyhydric alcohols such as glycerin, pentaerythritol, sorbit, sorbitan, and oxyalkylene ethers of novolac-type phenolic resins may be also used as the alcohol component. Polyvalent carboxylic acids such as trimellitic acid, pyromellitic acid, 1,2,3,4-butanetetracarboxylic acid, and benzophenonetetracarboxylic acid, and anhydrides thereof may be used as the carboxylic acid component.

Among the alcohol components, the derivatives of bisphenol A which are represented by Formula (I) above are preferred because excellent charging characteristic and environmental resistance are attained and balanced with other electrophotographic characteristics. It is also preferred that the average value of x+y be at least 2 and not more than 10.

It is also preferred that in the amorphous polyester resin, the alcohol component take at least 45 mol % and not more than 55 mol % and the carboxylic acid component take at least 45 mol % and not more than 55 mol % with respect to the total amount of the alcohol component and carboxylic acid component.

In the present invention, when the toner uses a core-shell structure, the added amount of the amorphous polyester resin is preferably at least 1.0 part by mass and not more than 30.0 parts by mass, and more preferably at least 1.0 part by mass and not more than 20.0 parts by mass, per 100 parts by mass of the binder resin.

The number-average molecular weight (Mn) of the amorphous polyester resin is preferably at least 2500 and not more than 20,000. Where the number-average molecular weight (Mn) is at least 2500 and not more than 20,000, the developing performance, blocking resistance, and durability can be improved without impairing the fixing performance. The number-average molecular weight (Mn) of the amorphous polyester resin can be measured using gel permeation chromatography (GPC).

The toner of the present invention can be produced by any well-known method.

However, from the standpoint of facilitating the control of the presence state of the domains of the crystalline polyester, it is preferred that a method for producing a toner be used in which the toner is produced in an aqueous medium, such as a suspension polymerization method, dissolution suspension method and an emulsion aggregation method.

Among them, the suspension polymerization method is more preferred because the presence ratio (25% ratio) of the domains of the crystalline polyester can be easily controlled to the desired range.

When the toner is produced using the emulsion aggregation method, the domains of the crystalline polyester are easily dispersed in the entire interior of the toner. In this case, the theoretically calculated presence ratio (25% ratio) of the domains of the crystalline polyester is 43.8 number %. Therefore, in order to make the 25% ratio at least 60 number % when the emulsion aggregation method is used, it is necessary to use such measures as performing the aggregation step a plurality of times and aggregating the crystalline polyester fine particles later in the aggregation steps.

The suspension polymerization method is explained hereinbelow in greater detail, but this method is not limiting.

A method for producing a toner by using the suspension polymerization method includes:

a step of dispersing a polymerizable monomer composition including a polymerizable monomer constituting a binder resin, a colorant, a crystalline polyester, a release agent, and optional components such as a polymerization initiator, a crosslinking agent, a charge control agent, and other additives in a continuous phase (for example, an aqueous medium) including a dispersing agent by using an appropriate stirrer, and forming particles of the polymerizable monomer composition in the aqueous medium; and a step of polymerizing the polymerizable monomer included in the particles of the polymerizable monomer composition.

The stirring intensity of the stirrer may be selected with consideration for material dispersibility and productivity. In the step of polymerizing the polymerizable monomer, the polymerization temperature may be set to at least 40° C. and generally to at least 50° C. and not more than 90° C.

Examples of the polymerizable monomer are listed below.

Styrene-based monomers such as styrene, o-methyl styrene, m-methyl styrene, p-methyl styrene, p-methoxystyrene, and p-ethylstyrene; acrylic acid ester monomers and methacrylic acid ester monomers such as methyl acrylate, ethyl acrylate, n-propyl acrylate, n-butyl acrylate, isobutyl acrylate, n-octyl acrylate, dodecyl acrylate, 2-ethylhexyl acrylate, stearyl acrylate, 2-chloroethyl acrylate, phenyl acrylate, methyl methacrylate, ethyl methacrylate, n-propyl methacrylate, n-butyl methacrylate, isobutyl methacrylate, tert-butyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylonitrile, methacrylonitrile, and acrylamide.

These polymerizable monomers can be used individually or in a mixture.

Among these polymerizable monomers, from the standpoint of storage stability and durability of the toner, it is preferred that a mixture of a styrene-based monomer and an acrylic acid ester monomer or methacrylic acid ester monomer be used.

The amount of the styrene-based monomer in the polymerizable monomer is preferably at least 60 mass % and not more than 90 mass %, and more preferably at least 65 mass % and not more than 85 mass %. Meanwhile, the amount of the acrylic acid ester monomer or methacrylic acid ester monomer is preferably at least 10 mass % and not more than 40 mass %, and more preferably at least 15 mass % and not more than 35 mass %.

Various polymerization initiators such as peroxide-based polymerization initiators and azo-based polymerization initiators may be used as the polymerization initiator.

Examples of the aqueous medium include water; alcohols such as methyl alcohol, ethyl alcohol, modified ethyl alcohol, isopropyl alcohol, n-butyl alcohol, isobutyl alcohols, tert-butyl alcohol, and sec-butyl alcohol; and ether alcohols such as methyl cellosolve, cellosolve, isopropyl cellosolve, butyl cellosolve, and diethylene glycol monobutyl ether. Other examples include water-soluble media, namely, ketones such as acetone, methyl ethyl ketone, and methyl isobutyl ketone; esters such as ethyl acetate; ethers such as ethyl ether and ethylene glycol; acetals such as methylal and diethyl acetal; and acids such as formic acid, acetic acid, and propionic acid. Among them, water and alcohols are preferred. These solvents can be also used in a mixture of two or more thereof.

The concentration of the polymerizable monomer composition is preferably at least 1 mass % and not more than 80 mass %, and more preferably at least 10 mass % and not more than 65 mass % with respect to the aqueous medium.

Well-known dispersing agents can be used. Examples of the inorganic dispersing agents include calcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Suitable organic dispersing agents can be obtained by dispersing polyvinyl alcohol, gelatin, methyl cellulose, methylhydroxypropyl cellulose, ethyl cellulose, carboxymethyl cellulose sodium salt, polyacrylic acid and salts thereof, and starch in a water phase.

These dispersing agents may be used individually or a plurality thereof may be used together. A surfactant may be used in addition to the dispersing agent.

The concentration of the dispersing agent is preferably at least 0.2 parts by mass and not more than 20.0 parts by mass per 100 parts by mass of the polymerizable monomer composition.

Well-known crosslinking agents can be used. Examples thereof mainly include compounds having two or more polymerizable double bonds.

Specific examples include aromatic divinyl compounds such as divinyl benzene and divinyl naphthalene; carboxylic acid esters having two double bonds, such as ethylene glycol diacrylate, ethylene glycol dimethacrylate, and 1,3-butanediol dimethacrylate; divinyl compounds such as divinyl aniline, divinyl ether, divinyl sulfide, and divinyl sulfone; and compounds having three or more vinyl groups.

These compounds may be used individually or a plurality thereof may be used together.

The crosslinking agent is preferably added in an amount of at least 0.01 parts by mass and not more than 10.0 parts by mass per 100 parts by mass of the polymerizable monomer.

In the present invention, the presence state of the crystalline polyester domains in the cross-sectional image of the toner is easily controlled to the above-described range by using the following procedure.

For example, the polymerizable monomer is polymerized to obtain resin particles, the resin particles are then dispersed in an aqueous medium, and the temperature of the resulting dispersion is raised to a temperature exceeding the melting points of the crystalline polyester and release agent. However, where the polymerization temperature is higher than the melting points, this operation is not needed.

After the temperature has risen, the dispersion may be cooled at a rate of temperature decrease of at least 10° C./min and not more than 3000° C./min (preferably at least 90° C./min and not more than 3000° C./min) in order to raise the degree of crystallization of the crystalline polyester.

The degree of crystallization of the crystalline polyester can be raised by cooling as this specific rate. Where such a cooling step is implemented, the number-average major diameter of the domains of the crystalline polyester is easily controlled to at least 50 nm and not more than 300 nm. At the same time, the number of the domains of the crystalline polyester is easily controlled to at least 8 and not more than 500.

Where the degree of crystallization of the crystalline polyester is wished to be increased, generally, the dispersion needs to be gradually cooled after the temperature thereof has risen, or heat treatment needs to be implemented for a long time close to the crystallization temperature of the crystalline polyester.

However, the investigation conducted by the inventors has revealed the phenomenon of the degree of crystallization of the crystalline polyester rising as a result of combined use of a crystalline polyester and a release agent and the implementation of rapid cooling of the dispersion at least 10° C./min when the suspension polymerization method is used.

The reason that the degree of crystallization of the crystalline polyester is increased is that rapid cooling results in the formation of independent crystal nuclei of the release agent, but independent crystal growth is impeded and the release agent and the crystalline polyester tend to crystallize at the same time.

For this phenomenon to be expressed more prominently, it is preferred that an ester wax that is similar in structure to the crystalline polyester be used as the release agent. Furthermore, when a bifunctional ester wax is used, the degree of crystallization of the crystalline polyester can be further increased and the presence state of the crystalline polyester domains can be easily controlled to the abovementioned range.

Meanwhile, where a crystalline polyester and ester wax are used, the presence state of the crystalline polyester domains can be also controlled by heat treating the dispersion for a long time close to the crystallization temperature of the crystalline polyester (more specifically, within ±10° C. of the crystallization temperature of the crystalline polyester).

The heat treatment is performed preferably for at least 1 h and not more than 24 h, and more preferably for at least 2 h and not more than 24 h.

Meanwhile, in order to control the presence ratio (25% ratio) of the crystalline polyester domains to at least 60 number %, for example, the acid value of the crystalline polyester may be controlled to a predetermined range, as mentioned hereinabove. Further, as a result of using a release agent (for example, an ester wax) easily compatible with the binder resin together with a release agent (for example, an aliphatic hydrocarbon wax) which is hardly compatible with the binder resin, the domains of the crystalline polyester are unlikely to be present close to the centroid of the cross-sectional image of the toner and the 25% ratio can be controlled to a range of at least 60 number %.

Toner particles are obtained by filtering, washing, and drying by the well-known methods the resin particles obtained by the above-described treatment. A toner may be also obtained by optionally mixing the toner particles with an external additive to cause the adhesion of the external additive to the surface thereof.

A classification step can be implemented prior to adding the external additive, so that coarse or fine particles contained among the toner particles could be cut.

The external additive may be added and mixed with the toner particles to ensure charging uniformity and improve flowability of the toner, and the added external additive may be present in a state of adhesion to the surface of the toner.

The number-average diameter (D1) of the primary particles of the external additive is preferably at least 4 nm and not more than 500 nm.

Examples of suitable external additives include inorganic fine particles selected from silica fine particles, alumina fine particles, and titania fine particles and complex oxides thereof. Examples of complex oxides include silica-aluminum fine particles and strontium titanate fine particles. The surface of these inorganic fine particles is preferably hydrophobized prior to use.

The toner particles of the present invention can also use other additives in a small amount within ranges in which no substantial adverse effect is produced, examples of such other additives including a lubricant powder such as a Teflon™ powder, a zinc stearate powder, and a polyvinylidene fluoride powder, abrasive agents such as a cerium oxide powder and a silicon carbide powder, a caking preventing agent, and organic and/or inorganic fine particles of a reverse polarity as a developing performance improving agent. The surface of these additives can be also hydrophobized prior to use.

The amount of the external additive is preferably at least 0.010 parts by mass and not more than 8.0 parts by mass, and more preferably at least 0.10 parts by mass and not more than 4.0 parts by mass, per 100 parts by mass of the toner particles.

The glass transition temperature (Tg) of the toner of the present invention is preferably at least 40° C. and not more than 60° C. Within this range, both the low-temperature fixability and the storage ability can be achieved.

The weight-average particle diameter (D4) of the toner of the present invention is preferably at least 3.0 μm and not more than 12.0 μm, and more preferably at least 4.0 μm and not more than 10.0 μm. Where the weight-average particle diameter (D4) is at least 3.0 μm and not more than 12.0 μm, good flowability is obtained and a latent image can be faithfully developed.

The average circularity of the toner of the present invention is preferably at least 0.960 and not more than 1.000, and the mode circularity of the toner is preferably at least 0.970 and not more than 1.000.

Where the average circularity of the toner is at least 0.960, the toner has a spherical shape or a shape close thereto, excels in flowability, and tends to have uniform triboelectric charging performance. Further, with a toner having a high mode circularity, the toner at the time of fixing tends to be in a closest packing, the heat of the fixing unit is likely to be transmitted to a plurality of toner particles, and the low-temperature fixability tends to improve.

The toner obtained by the suspension polymerization method is easily controlled to high average circularity and mode circularity.

Figure 3:
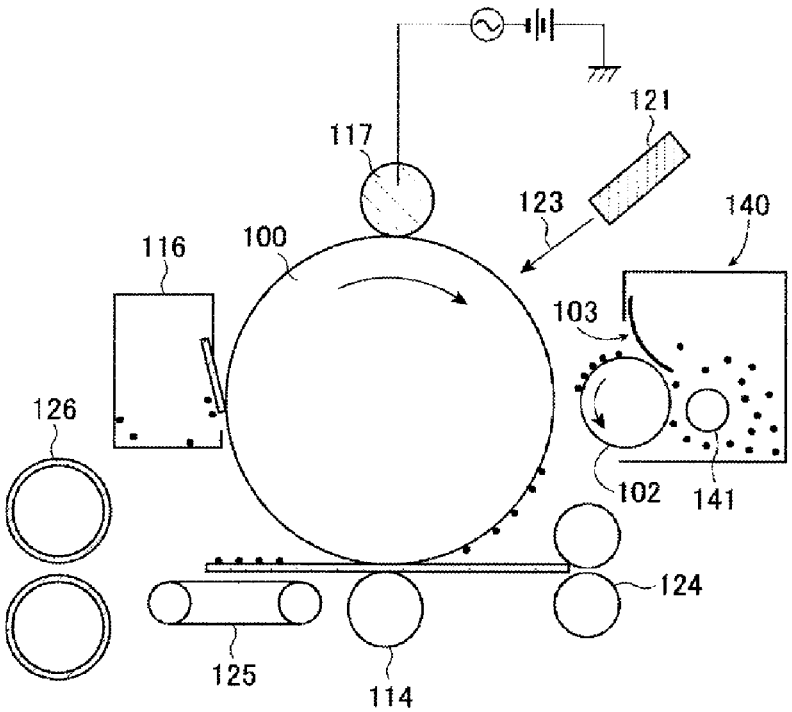
FIG. 3 is a schematic cross-sectional view illustrating an example of an image forming apparatus.

An example of an image forming apparatus capable of advantageously using the toner will be explained hereinbelow with reference to FIG. 3. In FIG. 3, the reference numeral 100 stands for an electrostatic latent image bearing member (also referred to hereinbelow as "photosensitive member"). A charging member (charging roller) 117, a toner carrying member 102, a developing device 140 having a developing blade 103 and a stirring member 141, a transfer member (transfer charging roller) 114, a cleaner container 116, a fixing unit 126, a pick-up roller 124, a transport belt 125 and the like are provided and the periphery to the photosensitive member. The photosensitive member 100 is charged by the charging roller 117, for example, to −600 V (the applied voltage is, for example, an AC voltage of 1.85 kVpp and a DC voltage of −620 Vdc). Then, exposure is performed by irradiating the photosensitive member 100 with a laser beam 123 from a laser generator 121, and an electrostatic latent image corresponding to the target image is formed. The electrostatic latent image on the photosensitive member 100 is developed with a single-component toner by the developing device 140 to obtain a toner image, and the toner image is transferred onto a transfer material by the transfer charging roller 114 which is in contact with the photosensitive member, the transfer material being interposed therebetween. The transfer material carrying the toner image is transported by the transport belt 125 or the like to the fixing unit 126, and the image is fixed on the transfer material. Further, the toner remaining on parts of the photosensitive member is cleaned with the cleaner container 116.

Described herein is an image forming apparatus using magnetic single-component jumping development, but the toner is also suitable for a method using jumping development or contact development.

Methods for measuring various properties of the toner according to the present invention are described hereinbelow.

<Method for Measuring Weight-Average Particle Diameter (D4) of the Toner>

The weight-average particle diameter (D4) is calculated in the following manner. A precision particle size distribution measuring device "Coulter Counter Multisizer 3" (registered trademark, manufactured by Beckman Coulter, Inc.) based on a pore electrical resistance method and equipped with a 100-μm aperture tube is used as a measurement device. The included dedicated software "Beckman Coulter Multisizer 3 Version 3.51" (manufactured by Beckman Coulter, Inc.) is used for setting the measurement conditions and analyzing the measured data. The measurements are performed at an effective measurement channel number of 25,000.

An aqueous electrolytic solution used for the measurements is obtained by dissolving reagent-grade sodium chloride in ion-exchanged water to a concentration of about 1 mass %. For example, "ISOTON II" (manufactured by Beckman Coulter, Inc.) can be used.

The dedicated software is set in the following manner before the measurements and analysis are performed.

On the "Change of Standard Measurement Method (SOM)" screen of the dedicated software, the total count number of the control mode is set to 50,000 particles, the number of measurement runs is set to one, and the Kd value is set to a value obtained by using "10.0-μm Standard Particles" (manufactured by Beckman Coulter, Inc.). A threshold and a noise level are automatically set by pushing the "Threshold/Noise Level Measurement Button". Further, the current is set to 1600 μA, the gain is set to 2, the aqueous electrolytic solution is set to ISOTON II, and the "Flush of Aperture Tube After Measurements" is checked.

On the "Setting of Pulse-to-Particle Diameter Conversion" screen of the dedicated software, a bin interval is set to a logarithmic particle diameter, a particle diameter bin is set to the 256 particle size bin, and the particle diameter range is set from 2 μm to 60 μm.

The specific measurement method is described below.

(1) A total of about 200 mL of the aqueous electrolytic solution is placed in a 250-mL round-bottom glass beaker specifically designed for Multisizer 3, and the beaker is set on a sample stand. Agitation with a stirrer rod is performed counterclockwise at 24 rev/s. The dirt and air bubbles in the aperture tube are removed with the function of "Flush of Aperture" of the dedicated software.

(2) A total of about 30 mL of the aqueous electrolytic solution is placed in a 100-mL flat-bottom glass beaker, and about 0.3 mL of a diluted solution prepared by about 3-fold, in terms of mass, dilution of "Contaminon N" (a 10 mass % aqueous solution of a neutral detergent which has pH of 7 and used for washing precision measurement devices, the neutral detergent including a nonionic surfactant, an anionic surfactant, and an organic builder; manufactured by Wako Pure Chemical Industries, Ltd.) with ion-exchanged water is added as a dispersing agent thereto.

(3) An ultrasonic disperser "Ultrasonic Dispersion System Tetora 150" (manufactured by Nikkaki Bios Co., Ltd.) is prepared which incorporates two oscillators with an oscillation frequency of 50 kHz in a state with a phase shift of 180 degrees therebetween and which has an electrical output of 120 W. About 3.3 L of ion-exchanged water is placed in a water tank of the ultrasonic disperser, and about 2 mL of the Contaminon N is added to the water tank.

(4) The beaker, as disclosed in clause (2) above, is set in the beaker fixing hole of the ultrasonic disperser, and the ultrasonic disperser is actuated. The height position of the beaker is adjusted such as to maximize the resonance state of the liquid surface of the aqueous electrolytic solution in the beaker.

(5) In a state in which the aqueous electrolytic solution inside the beaker, as disclosed in clause (4) above, is irradiated with ultrasonic waves, about 10 mg of the toner is added portionwise to the aqueous electrolytic solution and dispersed therein. The ultrasonic dispersion treatment is then continued for 60 s. During the ultrasonic dispersion, the temperature of water in the water tank is adjusted, as appropriate, to be at least 10° C. and not more than 40° C.

(6) The aqueous electrolytic solution, as disclosed in clause (5) above, in which the toner has been dispersed, is dropwise added with a pipette to the round-bottom beaker, as disclosed in clause (1) above, which has been placed in the sample stand, and the measured concentration is adjusted to about 5%. The measurements are performed till the number of measured particles reaches 50,000.

(7) The weight-average particle diameter (D4) is calculated by analyzing the measured data with the dedicated software included with the device. The "Average Diameter" on the "Analysis/Volume Statistical Value (Arithmetic Average)" screen when setting the graph/volume % in the dedicated software is the weight-average particle diameter (D4).

<Method for Measuring Thermal Conductivity of the Toner>

(1) Preparation of Sample

Two cylindrical samples each having a diameter of 25 mm and a height of 6 mm are prepared by compression molding about 5 g of the toner (the mass depends on the specific gravity of the sample) for 60 s under 20 MPa by using a tablet molding compressor under a 25° C. environment.

(2) Measurement of Thermal Conductivity

Measuring apparatus: hot disk method, thermophysical property measuring device TPS 2500S (manufactured by Hot Disk AB, Sweden)

Sample holder: sample holder for room temperature

Sensor: standard accessory (RTK) sensor

Software: Hot disk analysis 7

A sample is placed on a mounting table equipped with the sample holder for room temperature, and the height of the table is adjusted such that the sample surface is at the level of the sensor.

The second sample and a piece of accessory metal are placed on the sensor, and a pressure is applied using a screw disposed on the sensor. The pressure is adjusted to 30 cN·m by using a torque wrench. It is confirmed that the centers of the sample and the sensor are just below the screw.

The Hot disk analysis 7 is started, and "Bulk (Type I)" is selected as the test type.

The following items are inputted.

Available Probing Depth: 6 mm

Measurement time: 40 s

Heating Power: 60 mW

Sample Temperature: 23° C.

TCR: 0.004679 $K^{-1}$

Sensor Type: Disk

Sensor Material Type: Kapton

Sensor Design: 5465

Sensor Radius: 3.189 mm

After the input, the measurement is started. After completion of the measurement, the "Calculate" button is selected, "Start Point: 10" and "End Point: 200" are inputted, the "Standard Analysis" button is selected, and "Thermal Conductivity" [W/m·K] is calculated.

<Method for Observing Cross-Sectional Image of Toner in Scanning Transmission Electron Microscope (STEM)>

The cross-sectional image of the toner in a scanning transmission electron microscope (STEM) is prepared in the following manner.

Where the toner is stained with ruthenium, the crystalline resin contained in the toner has a high contrast and can be easily observed. When using ruthenium staining, the amount of the ruthenium atoms differs depending on the intensity of staining. Therefore, in a strongly stained portion, there are many ruthenium atoms, an electron beam is not transmitted, and the portion becomes black on the observation image. In a weakly stained portion, an electron beam is easily transmitted, and the portion becomes white on the observation image.

More specifically, the crystalline polyester is stained weaker than other organic components constituting the toner. This is apparently because seeping of the staining material into the crystalline polyester is weaker than into other organic components constituting the toner due to a difference in density, or the like.

The ruthenium which has not seeped into the crystalline polyester tends to remain on the interface of the crystalline polyester and the amorphous resin, and in the case of needle crystals, the crystalline polyester becomes black on the observation image. Meanwhile, in the release agent, the seeping of ruthenium is more suppressed. As a result, the release agent is observed as the whitest portion.

The procedure for preparing the cross section of the toner stained with ruthenium is described below.

Initially, the toner is sprayed to obtain a single layer on a cover glass (manufactured by Matsunami Glass Ind., Ltd.; square cover glass; square No. 1), and an osmium plasma coater (Filgen Inc., OPC80T) is used to form an Os film (5 nm) and a naphthalene film (20 nm) as protective films.

Then, a PTFE tube (Φ1.5 mm×Φ3 mm×3 mm) is packed with a photocurable resin D800 (manufactured by JEOL Ltd.), and the cover glass is placed quietly on the tube in an orientation such that the toner is in contact with the photocurable resin D800. In this state, the resin is cured by irradiation with light, and the cover glass is then removed from the tube, thereby forming a cylindrical resin with the toner embedded in the outermost surface.

The resin is then cut with an ultrasonic Ultramicrotome (Leica, Inc., UC7) at a cutting rate of 0.6 mm/s from the outermost surface of the cylindrical resin through the radial length (for example, through 4.0 μm when the weight-average particle diameter (D4) is 8.0 μm) of the toner and the cross section of the central portion of the toner is exposed.

A thin sample of the toner cross section is then prepared by cutting to a film thickness of 250 nm. By performing cutting according to such procedure, it is possible to obtain the cross section of the central portion of the toner.

The resulting thin sample is stained for 15 min under a 500 Pa atmosphere of a $RuO_4$ gas by using a vacuum electron staining apparatus (Filgen, Inc., VSC4R1H), and a STEM image is produced using the scanning image mode of a scanning transmission electron microscope (JEOL Ltd., JEM2800).

The STEM probe size is 1 nm and the image is acquired at an image size of 1024×1024 pixels. The image is acquired by adjusting "Contrast" to 1425 and "Brightness" to 3750 on the "Detector Control" panel of a bright-field image and adjusting "Contrast" to 0.0, "Brightness" to 0.5, and "Gamma" to 1.00 on the "Image Control" panel.

The resulting STEM image is binarized (threshold 120/255 stages) with image processing software "Image-Pro Plus" (produced by Media Cybernetics, Inc.).

A portion surrounded by a black boundary line when the binarization threshold is 120 is the crystalline polyester, and the portion that appears to be white when the binarization threshold is 210 is the release agent.

<Method for Identifying Domains of Crystalline Polyester and Release Agent>

The domains of the crystalline polyester and the release agent are identified on the basis of the STEM image by the following procedure.

Where the crystalline polyester and the release agent are available as starting materials, images of the lamella structures of respective crystals of the starting materials are obtained in the same manner as in the above-described observation method using ruthenium staining and a scanning transmission electron microscope (STEM). These structures are compared with the lamella structure of domains in the cross-sectional image of the toner, and where the lamella interlayer spacing involves an error of not more than 10%, identification can be performed with the starting materials forming the domains in the cross-sectional image of the toner.

Where the starting materials of the crystalline polyester and the release agent are not available, the following isolation operation is performed. Initially, the toner is dispersed in ethanol which is a poor solvent for the toner, and the temperature is raised to a level above the melting points of the crystalline polyester and the release agent. In this case, pressurization may be used, if necessary. At this time, the crystalline polyester and the release agent heated to above the melting points thereof are melted. A mixture of the crystalline polyester and the release agent can thereafter be collected from the toner by solid-liquid separation. The isolation of the crystalline polyester and the release agent is possible by fractionating the mixture based on the molecular weight.

<Method for Measuring Number-Average Major Diameter of Domains of Crystalline Polyester>

The number-average major diameter of the crystalline polyester means a number-average diameter determined from the major diameters of the domains of the crystalline polyester on the basis of the STEM image.

The number-average major diameter of the domains of the crystalline polyester is measured on the basis of the STEM image.

More specifically, 100 cross-sectional images of the toner are observed. The major diameters of all of the crystalline polyester domains present in the 100 cross-sectional images of the toner are measured and the arithmetic average value thereof is calculated. The resulting arithmetic average value is taken as the number-average major diameter of the domains of the crystalline polyester.

<Method for Measuring the Number of Domains of Crystalline Polyester>

The number of the domains of the crystalline polyester contained in one cross-sectional image of the toner is measured on the basis of the STEM image. The calculation is performed with respect to 100 cross-sectional images of the toner, and the arithmetic average value thereof is taken as the number of the domains of the crystalline polyester.

<Method for Measuring the Presence Ratio (25% Ratio) of Domains of Crystalline Polyester>

The 25% ratio is the ratio (number %) of the domains of the crystalline polyester present in an area from the outline of the cross-sectional image of the toner to 25% of the distance between the outline and the centroid of the cross-sectional image.

A method for calculating the 25% ratio is described below.

The centroid of the toner cross section in the STEM image is taken as the centroid of the cross-sectional image of the toner. A straight line is drawn from the obtained center point to a point on the outline of the cross-sectional image of the toner. A position on the straight line at 25% of the distance between the outline and the centroid of the cross-sectional image from the outline is specified.

This operation is performed on the entire outline of the cross-sectional image of the toner, and the boundary line at 25% of the distance between the outline and the centroid of the cross-sectional image from the outline of the cross-sectional image of the toner is clearly indicated (FIG. 2).

The number of the domains of the crystalline polyester in one cross-sectional image of the toner (referred to hereinbelow as "A"), and the number of the domains of the crystalline polyester present in the area from the outline of one cross-sectional image of the toner to 25% of the distance between the outline and the centroid of the cross-sectional image in the cross-sectional image of the toner (referred to hereinbelow as "B") are measured on the basis of the STEM image with a clearly indicated boundary line at 25%.

The domains of the crystalline polyester which are present on the boundary line at 25% are calculated as the "B".

The 25% ratio in one cross-sectional image of the toner is then calculated by the following formula.

$$\text{25\% ratio in one cross-sectional image of the toner} = \{\text{"}B\text{"}/\text{"}A\text{"}\} \times 100\%.$$

The calculation is performed with respect to 100 cross-sectional images of the toner, and the arithmetic average number thereof is taken as the 25% ratio.

<Method for Measuring the Ratio of Total Area of Domains of Release Agent>

The total area of the domains of the release agent in one cross-sectional image of the toner (referred to hereinbelow as "C") and the area of the cross-sectional image of the toner (referred to hereinbelow as "D") in the STEM image are calculated using the image processing software "Image-Pro Plus" (produced by Media Cybernetics, Inc.).

When a plurality of the domains of the release agent is present in one cross-sectional image of the toner, a value obtain by adding up the areas of the domains is taken as the total area of the domains of the release agent in one cross-sectional image of the toner.

The ratio of the total area of the domains of the release agent in one cross-sectional image of the toner is then calculated by the following formula.

Ratio of the total area of the domains of the release agent in one cross-sectional image of the toner={"C"/"D"}×100(area %).

The calculation is performed with respect to 100 cross-sectional images of the toner, and the arithmetic average number thereof is taken as the ratio of the total area of the domains of the release agent.

<Method for Measuring the Ratio of the Toner in which the Domains of Release Agent are Present in the Centroid of Cross-Sectional Image of Toner (Center Point Ratio)>

The centroid of the cross-sectional image of the toner in the STEM image is determined in the following manner.

The outline of the cross-sectional image of the toner is revealed in the cross-sectional image of the toner by using the image processing software "Image-Pro Plus" (produced by Media Cybernetics, Inc.).

The centroid of the cross-sectional image is taken as the centroid of the cross-sectional image of the toner.

The number of the cross-sectional images of the toner in which the domains of the release agent are present in the center point (referred to hereinbelow as "E") and the number of the cross-sectional images of the toner in which the domains of the release agent are not present in the center point (referred to hereinbelow as "F") are then measured with respect to at least 100 cross-sectional images of the toner.

The center point ratio of the toner is calculated by the following formula.

Center point ratio of the toner={"E"/"E+F"}×100 (number %).

<Method for Measuring Acid Value>

The acid value is the number of milligrams of potassium hydroxide required to neutralize the acid contained in 1 g of the sample. The acid value in the present invention is measured according to JIS K 0070-1992. More specifically, it is measured according to the following procedure.

(1) Preparation of Reagent

A total of 1.0 g of phenolphthalein is dissolved in 90 mL of ethyl alcohol (95 vol %), and ion-exchanged water is added to obtain 100 mL of a phenolphthalein solution.

A total of 7 g of a reagent-grade potassium hydroxide is dissolved in 5 mL of water, and ethyl alcohol (95 vol %) is added to obtain 1 L. The solution is placed in an alkali-resistant container so as to avoid contact with carbon dioxide, and allowed to stand for 3 days. Subsequent filtration produces a potassium hydroxide solution. The obtained potassium hydroxide solution is stored in an alkali-resistant container. The factor of the potassium hydroxide solution is determined by placing 25 mL of 0.1 mol/L hydrochloric acid into an Erlenmeyer flask, adding several drops of the phenolphthalein solution, titrating with the potassium hydroxide solution, and finding the factor from the amount of the potassium hydroxide solution required for neutralization. The 0.1 mol/L hydrochloric acid is prepared according to JIS K 8001-1998.

(2) Operations (A) Main Test

A total of 2.0 g of the pulverized sample is accurately weighed into a 200-mL Erlenmeyer flask, 100 mL of a mixed solution of toluene:ethanol (2:1) is added, and the sample is dissolved over 5 h. A few drops of the phenolphthalein solution as an indicator are then added and titration is performed using the potassium hydroxide solution. The end point of the titration is when a thin red color of the indicator is maintained for about 30 s.

(B) Blank Test

The titration is performed by the same operations, except that the sample is not used (that is, only the mixed solution of toluene:ethanol (2:1) is used).

(3) The results obtained are substituted in the following equation and the acid value is calculated.

$$A=[(C-B)\times f\times 5.61]/S.$$

Here, A: acid value (mg KOH/g); B: added amount (mL) of potassium hydroxide solution in the blank test; C: added amount (mL) of potassium hydroxide solution in the main test; f: factor of the potassium hydroxide solution; and S: sample (g).

<Method for Measuring Melting Point (Tm)>

The melting points of the crystalline polyester and the release agent are measured according to ASTM D3418-82 by using a differential scanning calorimeter "Q1000" (manufactured by TA Instruments).

Temperature correction of the device detector is performed using the melting points of indium and zinc, and heat of fusion of indium is used for correcting the heat quantity.

More specifically, 1 mg of the sample is accurately weighed and placed in an aluminum pan. An empty aluminum pan is used as a reference. The measurements are conducted in a measurement range from 20° C. to 140° C. with the following settings.

Rate of temperature rise and decrease: 10° C./min.

The temperature is raised from 20° C. to 140° C., and then lowered from 140° C. to 20° C. The temperature is then raised again from 20° C. to 140° C.

In the process in which the temperature is raised again, a specific heat change is obtained in a temperature range from 20° C. to 140° C. The peak temperature of the maximum endothermic peak in the specific heat change curve is taken as the melting point Tm (° C.).

<Method for Measuring Crystallization Temperature (Tc)>

The crystallization temperatures of the crystalline polyester and the release agent are measured using a differential scanning calorimeter "Q1000" (manufactured by TA Instruments).

Temperature correction of the device detector is performed using the melting points of indium and zinc, and heat of fusion of indium is used for correcting the heat quantity.

More specifically, 1 mg of the sample is accurately weighed and placed in an aluminum pan. An empty aluminum pan is used as a reference. The measurements are conducted in a measurement range from 20° C. to 140° C. with the following settings.

Rate of temperature rise and decrease: 10° C./min.

The temperature is raised from 20° C. to 140° C., and then lowered from 140° C. to 20° C.

In the process in which the temperature is lowered, a specific heat change is obtained in a temperature range from 140° C. to 20° C. The peak temperature of the maximum exothermic peak in the specific heat change curve is taken as the crystallization temperature (Tc: ° C.).

<Measurement of Amount of Carbon Adhered to Magnetic Body>

The amount of carbon adhered to the magnetic body is calculated by washing the magnetic body with styrene and then measuring the residual carbon amount derived from a silane compound.

Initially, the magnetic body is washed with styrene in the following procedure.

A total of 20 g of styrene and 1.0 g of the magnetic body are charged into a glass vial with a capacity of 50 mL, and the glass vial is set in "KM Shaker" (model: V. SX) manufactured by IWAKI INDUSTRY CO., LTD. The "speed" is set to 50, and a treatment agent contained in the magnetic body is caused to elute into the styrene by shaking for 1 h. The magnetic body and styrene are then separated and sufficiently dried with a vacuum dryer.

The following procedure is performed after the magnetic body has been washed with styrene.

The amount of carbon per unit mass of the resulting dry matter is measured using a carbon-sulfur analyzer (EMIA-320V, manufactured by HORIBA, Ltd.). The amount of carbon obtained in this operation is taken as the amount of carbon (mass %) adhered to the magnetic body. The amount of the sample charged when the measurement is performed with EMIA-320V is 0.20 g, and tungsten and tin are used as combustion improvers.

EXAMPLES

The present invention will be explained hereinbelow in greater detail with reference to production examples and embodiments, but the present invention is not limited thereto. "Parts" and "percentages" in the following formulations are all on the mass basis unless specified otherwise.

<Production Example of Magnetic Iron Oxide>

An aqueous solution of a ferrous salt including ferrous hydroxide colloid was obtained by mixing and stirring 55 L of a 4.0 mol/L aqueous solution of potassium hydroxide with 50 L of an aqueous solution of ferrous sulfate including $Fe^{2+}$ at 2.0 mol/L. The resulting aqueous solution was maintained at 85° C., and an oxidation reaction was performed, while blowing air at 20 L/min, to obtain a slurry including core particles.

The resulting slurry was filtered with a filter press and washed, and the core particles were then redispersed in water to obtain a redispersion solution.

Sodium silicate was added to the redispersion solution at 0.20 parts, calculated as silicon, per 100 parts of the core particles, the pH of the redispersion solution was adjusted to 6.0, and a slurry including magnetic iron oxide particles having a silicon-rich surface was obtained by stirring.

The resulting slurry was filtered with a filter press, washed and then redispersed in ion-exchanged water to obtain a redispersion solution.

A total of 500 g (10 mass % with respect to the magnetic iron oxide) of an ion-exchange resin SK110 (manufactured by Mitsubishi Chemical Corporation) was charged into the redispersion solution (solid fraction 50 g/L), and ion exchange was performed by stirring for 2 h. The ion-exchange resin was then filtered and removed with a mesh, filtration and washing were performed with a filter press, and subsequent drying and grinding produced magnetic iron oxide with a number-average particle diameter of 0.23 μm.

<Production Example of Silane Compound>

A total of 30 parts of iso-butyltrimethoxysilane was dropwise added to 70 parts of ion-exchanged water under stirring. The resulting aqueous solution was held at pH 5.5 and a temperature of 55° C. and dispersed for 120 min at a circumferential rate of 0.46 m/s by using a disper blade to hydrolyze the iso-butyltrimethoxysilane.

The aqueous solution was then adjusted to pH 7.0 and cooled to 10° C. to stop the hydrolysis reaction and obtain an aqueous solution including a silane compound.

<Production Example of Colorant 1>

A total of 100 parts of the magnetic iron oxide was placed in a high-speed mixer (LFS-2; manufactured by Fukae Powtec Corporation), and the aqueous solution including 8.0 parts of the silane compound was dropwise added over 2 min under stirring at a revolution speed of 2000 rpm. Mixing and stirring were then performed for 5 min.

In order to increase the fixing performance of the silane compound, drying was then performed for 1 h at 40° C., the amount of moisture was reduced, drying was then performed for 3 h at 110° C., and the condensation reaction of the silane compound was advanced.

A colorant 1 was then obtained by grinding and sieving through a sieve with a mesh size of 100 μm.

The amount of carbon adhered to the resulting colorant 1 is presented in Table 1.

<Production Examples of Colorants 2 to 4>

Colorants 2 to 4 were produced in the same manner as in the production example of colorant 1, except that the number of parts of the aqueous solution including the silane compound was changed to the values presented in Table 1. The amount of carbon adhered to the resulting colorants 2 to 4 is presented in Table 1.

<Colorant 5>

Carbon black was used as a colorant 5. The number-average particle diameter of primary particles of the carbon black used was 31 nm, the DPB adsorption amount was 40 mL/100 g, and the work function was 4.71 eV.

TABLE 1

| Colorant | Type | Number of parts by mass of aqueous solution including silane compound | Amount of adhered carbon (mass %) |
|---|---|---|---|
| Colorant 1 | Magnetic body | 8.0 | 0.48 |
| Colorant 2 | Magnetic body | 6.0 | 0.30 |
| Colorant 3 | Magnetic body | 5.0 | 0.25 |
| Colorant 4 | Magnetic body | 4.0 | 0.20 |
| Colorant 5 | Carbon black | — | — |

<Production Example of Crystalline Polyester 1>

A total of 185.5 parts of 1,9-nonanediol and 230.3 parts of sebacic acid were charged into a reaction tank equipped with a nitrogen-introducing tube, a dehydration tube, a stirrer, and a thermocouple. Tin (II) octylate was then added as a catalyst at 1 part per 100 parts of the total amount of the monomers, the reaction system was heated to 140° C. under a nitrogen atmosphere, and the reaction was conducted for 8 h under normal pressure while distilling-off water.

The reaction was then conducted while raising the temperature to 200° C. at 10° C./h, the reaction was conducted for 2 h after the temperature of 200° C. was reached, the pressure inside the reaction tank was then reduced to not more than 5 kPa, and the reaction was conducted for 3 h at 200° C. to obtain a crystalline polyester 1.

The acid value of the resulting crystalline polyester 1 was 2.0 mg KOH/g, the weight-average molecular weight (Mw) was 19,000, the melting point (Tm) was 74° C., and the crystallization temperature was 55° C.

<Production Example of Crystalline Polyester 2>

A crystalline polyester 2 was obtained in the same manner as in the production example of crystalline polyester 1, except that 1,9-nonanediol was replaced with 1,12-dodecanediol.

The acid value of the resulting crystalline polyester 2 was 0.3 mg KOH/g, the weight-average molecular weight (Mw)

was 22,000, the melting point (Tm) was 80° C., and the crystallization temperature was 55° C.

<Production Example of Release Agent 1>

A total of 1000 g of paraffin wax as a starting material substance was placed in a cylindrical glass reactor, and the temperature was raised to 140° C., while blowing a small amount (3 L/min) of nitrogen gas. A total of 0.30 mol of a mixed catalyst including boric acid and boric anhydride at a molar ratio of 1.5 was added, and the reaction was conducted for 4 h at 170° C., while blowing air (21 L/min) and nitrogen (18 L/min).

An equal amount of hot water (95° C.) was added to the reaction mixture obtained after the end of the reaction, and a release agent A was obtained by hydrolyzing the reaction mixture.

A total of 100 g of the release agent A was placed in a vessel equipped with a stirrer, a reflux cooler, and a heating heater, 1 L of ethanol was added as a solvent, and the release agent was sufficiently dissolved by heating for 1 h while stirring at a solvent reflux temperature.

After the release agent was confirmed to be dissolved in the solvent, the temperature was lowered to a normal temperature to precipitate the release agent. The precipitated release agent was collected by filtration, and the solvent was removed by distillation under reduced pressure to obtain a purified release agent 1.

The acid value of the release agent 1 was 3.1 mg KOH/g, the melting point (Tm) was 77° C., and the crystallization temperature was 76° C. Physical properties of the release agent 1 are shown in Table 2.

<Production Example of Release Agent 2>

A release agent 2 was produced in the same manner as in the production example of release agent 1, except that amount of the mixed catalyst including boric acid and boric anhydride at a molar ratio of 1.5 was changed to 0.45. Physical properties of the release agent 2 are shown in Table 2.

<Production Example of Release Agent 3>

A release agent 3 was produced in the same manner as in the production example of release agent 1, except that the modification step using the mixed catalyst including boric acid and boric anhydride at a molar ratio of 1.5 was not performed. Physical properties of the release agent 3 are shown in Table 2.

<Release Agents 4 to 6>

The ester waxes presented in Table 2 were used as a release agent 4, a release agent 5, and a release agent 6.

TABLE 2

| Release agent | Type | Denaturation | Melting point (° C.) | Crystallization temperature (° C.) | Acid value (mg KOH/g) |
|---|---|---|---|---|---|
| Release agent 1 | Paraffin wax | Yes | 77 | 74 | 3.1 |
| Release agent 2 | Paraffin wax | Yes | 77 | 74 | 10.1 |
| Release agent 3 | Paraffin wax | No | 77 | 74 | 0.0 |
| Release agent 4 | Dibehenyl sebacate | No | 73 | 70 | 0.5 |
| Release agent 5 | Behenyl behenate | No | 71 | 69 | 0.5 |
| Release agent 6 | Pentaerythritol tetrastearate | No | 76 | 72 | 0.5 |

<Production Example of Toner 1>

A total of 450 parts of a 0.1 mol/L aqueous solution of $Na_3PO_4$ was charged into 720 parts of ion-exchanged water, followed by heating to 60° C. A total of 67.7 parts of a 1.0 mol/L aqueous solution of $CaCl_2$ was then added to obtain an aqueous medium including a dispersing agent.

| | |
|---|---|
| Styrene | 79.0 parts |
| n-Butyl acrylate | 21.0 parts |
| Divinylbenzene | 0.6 parts |
| Iron complex of monoazo dye (T-77, manufactured by HODOGAYA CHEMICAL CO., LTD.) | 1.5 parts |
| Colorant 1 | 90.0 parts |
| Saturated polyester resin | 3.0 parts |

(saturated polyester resin obtained by a condensation polymerization reaction of an ethylene oxide (2 mol) adduct of bisphenol A and terephthalic acid; number-average molecular weight=5000, acid value=6 mg KOH/g, and glass transition temperature=68° C.)

The above formulation was uniformly dispersed and mixed using an attritor (Mitsui Miike Chemical Engineering Machinery Co., Ltd.). The mixture was heated to 63° C., and 5.0 parts of the crystalline polyester 1, 5.0 parts of the release agent 4 (dibehenyl sebacate), which is presented in Table 2, as an ester wax, and 8.0 parts of the release agent 3 (paraffin wax), which is presented in Table 2, as a paraffin wax, were added, mixed, and dissolved. Then, 9.0 parts of tert-butylperoxypivalate as a polymerization initiator was dissolved to obtain a polymerizable monomer composition.

The polymerizable monomer composition was charged into the aqueous medium and stirred at 12,000 rpm for 10 min at 60° C. with a TK-type homomixer (Tokushu Kika Kogyo Co., Ltd.) under a nitrogen atmosphere to form particles of the polymerizable monomer composition.

Then, the polymerization reaction was conducted for 4 h at 70° C. while stirring with a paddle stirring blade. After completion of the reaction, the resulting dispersion of resin particles was heated to 100° C. and held for 2 h.

Then, in a cooling step, ice was charged in the dispersion, and the dispersion was cooled from 100° C. to 20° C. over 2 min.

The cooled dispersion was washed by adding hydrochloric acid, and then filtered and dried to obtain toner particles 1. The glass transition temperature (Tg) of the toner particles 1 was 52° C.

Then, 100 parts of the toner particles 1 and 0.8 parts of hydrophobic silica fine particles having a number-average particle diameter of primary particles of 8 nm and a BET value of 300 $m^2/g$ were mixed using a Henschel mixer (Mitsui Miike Chemical Engineering Machinery Co., Ltd.) to obtain a toner 1. The lamella interlayer spacing in the domains of the crystalline polyester was measured from the cross-sectional image of the toner 1 observed under a scanning transmission electron microscope (STEM), and the domains of the crystalline polyester were confirmed to be the domains of the crystalline polyester 1. Physical properties of the toner 1 are shown in Table 4.

<Production Example of Toner 2>

A toner 2 was produced in the same manner as in the production example of toner 1, except that the cooling step was not implemented and, instead, the dispersion of resin particles was heated to 100° C. and held for 2 h, and the dispersion was then cooled from 100° C. to 55° C. over 20 min and heat treated for 8 h at 55° C. Physical properties of the toner 2 are shown in Table 4.

<Production Examples of Toners 3 to 15 and Comparative Toners 1 to 5>

Toners 3 to 15 and comparative toners 1 to 5 were produced in the same manner as in the production example of toner 1, except that the type and the number of parts of the colorant, the type and the number of parts of the crystalline polyester, the type and the number of parts of the ester wax, the type and the number of parts of the paraffin wax, and the cooling step were changed as shown in Table 3. Physical properties of the resulting toners are shown in Table 4. In order to control a low 25% ratio of the crystalline polyester in the comparative toners 4 and 5, a homogenizer (VP-055, manufactured by TAITEC CORPORATION) was irradiated with ultrasonic radiation at an output of 10 W in the course of the polymerization reaction conducted for 4 h at 70° C.

In "Ice cooling 1" represented in Table 3, ice was charged into the dispersion and the dispersion was cooled from 100° C. to 20° C. for 2 min, as in the cooling step of the production example of toner 1.

In "Ice cooling 2", the amount of ice charged in "Ice cooling 1" was changed and cooling was performed from 100° C. to 20° C. for 10 min.

In "Ice cooling 3", the amount of ice charged in "Ice cooling 1" was changed and cooling was performed from 100° C. to 20° C. for 1 min.

In "Ice cooling 4", the amount of ice charged in "Ice cooling 1" was changed and cooling was performed from 100° C. to 20° C. for 30 min.

<Production Example of Comparative Toner 6>

[Preparation of Resin Particle-Dispersed Solution Including Crystalline Polyester]

(First-Stage Polymerization)

A total of 4 parts of polyoxyethylene-2-dodecyl ether sodium sulfate and 3000 parts of ion-exchanged water were charged into a reaction vessel equipped with a stirrer, a temperature sensor, a cooling tube, and a nitrogen-introducing device, and the internal temperature was raised to 80° C. while stirring at a stirring rate of 230 rpm under a nitrogen gas flow. After the temperature rise, a solution prepared by dissolving 10 parts of potassium persulfate in 200 parts of ion-exchanged water was added, the liquid temperature was adjusted to 75° C., a liquid mixture including the following monomers was dropwise added over 1 h, and resin particles were then obtained by performing polymerization by heating and stirring for 2 h at 75° C. These resin particles will be referred to as "resin particles (1A)".

The liquid mixture included the following monomers:

| | |
|---|---|
| Styrene | 532 parts |
| n-Butyl acrylate | 200 parts |
| Methacrylic acid | 68 parts |
| n-Octyl mercaptan | 16 parts |

(Second-Stage Polymerization)

A liquid mixture including the following monomers was heated to 80° C. under stirring, and 150 parts of the crystalline polyester 1 was dissolved therein to prepare a liquid monomer mixture including the crystalline polyester.

The liquid mixture included the following monomers:

| | |
|---|---|
| Styrene | 190 parts |
| n-Butyl acrylate | 100 parts |
| Methacrylic acid | 20 parts |

A solution obtained by dissolving 2 parts of polyoxyethylene-2-dodecyl ether sodium sulfate in 3000 parts of ion-exchanged water was charged into a reaction vessel equipped with a stirrer, a temperature sensor, a cooling tube, and a nitrogen-introducing device and the solution was heated to 80° C. Then, 52 parts (calculated as solids) of the resin particles (1A) and the liquid monomer mixture including the crystalline polyester resin were added, and a dispersion solution including emulsion particles (oil droplets) was prepared by mixing and dispersing for 60 min with a mechanical disperser "CLEARMIX" (manufactured by M TECHNIQUE Co., Ltd.) having a circulation path.

A polymerization initiator solution prepared by dissolving 5 parts of potassium persulfate in 100 parts of ion-exchanged water was then added to the dispersion solution, polymerization was performed by heating and stirring the system for 1 h at 80° C., and a dispersion solution in which resin particles were dispersed was obtained.

(Third-Stage Polymerization)

A solution prepared by dissolving 10 parts of potassium persulfate in 200 parts of ion-exchanged water was further added to the dispersion solution, and a liquid mixture including the following monomers was dropwise added over 1 h under a temperature condition of 80° C.

| | |
|---|---|
| Styrene | 420 parts |
| n-Butyl acrylate | 206 parts |
| Methacrylic acid | 44 parts |
| n-Octyl mercaptan | 10 parts |

Upon completion of the dropwise addition, the polymerization was performed by heating and stirring for 2 h, and the system was then cooled to 28° C. to obtain a dispersion solution including resin particles. This dispersion solution will be referred to as "resin particle-dispersed solution 1 including crystalline polyester".

[Preparation of Resin Particle-Dispersed Solution 1 Including Wax]

A total of 100 parts of the release agent 3 was added to and mixed with a surfactant solution, which was prepared by dissolving 5.5 parts of polyoxyethylene-2-dodecyl ether sodium sulfate in 1350 parts of ion-exchanged water, in a four-neck flask equipped with a stirrer, a cooling tube, and a temperature sensor. Then, an emulsified dispersion solution was prepared by dispersing for 30 min at 80° C. with the mechanical disperser "CLEARMIX" (manufactured by M TECHNIQUE Co., Ltd.).

Separately, 1500 parts of ion-exchanged water was placed in a reaction vessel equipped with a stirrer, a temperature sensor, a cooling tube, and a nitrogen-introducing device, the ion-exchanged water was preheated to 78° C. and the emulsified dispersion solution was added thereto. Then, an aqueous solution of a polymerization initiator obtained by dissolving 19.5 parts of potassium persulfate in 370 parts of ion-exchanged water was added thereto. A mixture including 435 parts of styrene, 220 parts of n-butyl acrylate, 45 parts of methacrylic acid, and 8.5 parts of n-octyl mercaptan was then dropwise added over 90 min and a polymerization reaction was performed.

After the dropwise addition of the mixture, the polymerization was advance by heating and stirring for 2 h, followed by cooling to 28° C., thereby obtaining "resin particle-dispersed solution 1 including wax".

[Production of Colorant-Dispersed Solution]

A total of 90 parts of sodium dodecyl sulfate was stirred and dissolved in 1600 parts of ion-exchanged water. A total of 420 parts of the colorant 5 was gradually added to the solution under stirring. A solution including dispersed colorant particles was then produced by dispersing with the mechanical disperser "CLEARMIX" (manufactured by M TECHNIQUE Co., Ltd.). This solution will be referred to as "colorant-dispersed solution".

[Preparation of Toner]

(Aggregation and Fusion Step)

A total of 196 parts, calculated as solids, of the "resin particle-dispersed solution 1 including crystalline polyester", 196 parts, calculated as solids, of the "resin particle-dispersed solution 1 including wax", 1100 parts of ion-exchanged water, and 200 parts of the "colorant-dispersed solution" were charged into a reaction vessel equipped with a stirrer, a temperature sensor, a cooling tube, and a nitrogen-introducing device, and the liquid temperature was adjusted to 30° C. The pH was then adjusted to 10 by adding a 5N aqueous solution of sodium hydroxide.

Then, an aqueous solution prepared by dissolving 60 parts of magnesium chloride in 60 parts of ion-exchanged water was added over 10 min at 30° C. under stirring. After the liquid mixture in the reaction vessel was held for 3 min at 30° C., the temperature was raised to 80° C. over 60 min, and the particle growth reaction was continued, while keeping the temperature at 80° C.

In this state, the diameter of associated particles was measured with "Multisizer 3" (manufactured by Beckman Coulter, Inc.), and when the median diameter, based on the volume standard, became 6.0 μm, an aqueous solution of 40 parts of sodium chloride in 160 parts of ion-exchanged water was added to stop the particle growth. Then, in the fusion step, fusion between the particles was advanced by heating and stirring for 1 h at a liquid temperature of 80° C., and a dispersion solution including "core particles 1" was obtained.

(Aging and Cooling Step)

An aqueous solution of 150 parts of sodium chloride in 600 parts of ion-exchanged water was added to the dispersion solution including core particles 1, aging treatment was performed, and when the desired circularity was achieved, cooling was performed to 25° C. at 20° C./min to produce toner core particles.

(Washing and Drying Step)

The produced particles were solid-liquid separated with a basket-type centrifugal separator and a wet cake of toner core particles was formed. The wet cake was washed with ion-exchanged water at 35° C. in the basket-type centrifugal separator till the electric conductivity of the filtrate became 5 μS/cm, and the cake was then transferred to a "Flash Jet Dryer" (manufactured by SEISHIN ENTERPRISE Co., Ltd.) and dried to a moisture amount of 0.5 mass % to produce comparative toner particles 6.

A total of 100 parts of the comparative toner particles 6 and 0.8 parts of hydrophobic silica fine particles with a BET value of 300 $m^2/g$ and a number-average diameter of primary particles of 8 nm were mixed in a Henschel mixer (Mitsui Miike Chemical Engineering Machinery Co., Ltd.) to obtain a comparative toner 6. The lamella interlayer spacing in the domains of the crystalline polyester was measured from the cross-sectional image of the comparative toner 6 observed with the scanning transmission electron microscope (STEM), and the domains of the crystalline polyester were confirmed to be the domains of the crystalline polyester 1, but the 25% ratio of the crystalline polyester was 42 number %. Physical properties of the comparative toner 6 are shown in Table 4.

<Production of Comparative Toner 7>

| | |
|---|---|
| Saturated polyester resin (saturated polyester resin obtained by a condensation polymerization reaction of an ethylene oxide (2 mol) adduct of bisphenol A and terephthalic acid; number-average molecular weight = 5000, acid value = 6 mg KOH/g, and glass transition temperature = 68° C.) | 70 parts |
| Crystalline polyester 1 | 30 parts |
| Release agent 5 | 5 parts |
| Colorant 4 | 10 parts |

The above-described constituent materials of the toner were sufficiently stirred and mixed in a Henschel mixer (Mitsui Miike Chemical Engineering Machinery Co., Ltd.), then kneaded with a twin-screw extruder at 120° C., cooled, pulverized, and classified to obtain comparative toner particles 7 with a number-average particle diameter of 6.8 μm.

A total of 100 parts of the comparative toner particles 7 and 0.8 parts of hydrophobic silica fine particles with a BET value of 300 $m^2/g$ and a number-average diameter of primary particles of 8 nm were mixed in a Henschel mixer (Mitsui Miike Chemical Engineering Machinery Co., Ltd.) to obtain a comparative toner 7. The lamella interlayer spacing in the domains of the crystalline polyester was measured from the cross-sectional image of the comparative toner 7 observed with the scanning transmission electron microscope (STEM), and the domains of the crystalline polyester were confirmed to be the domains of the crystalline polyester 1, but the 25% ratio of the crystalline polyester was 42 number %. Physical properties of the comparative toner 7 are shown in Table 4.

<Production of Comparative Toner 8>

| | |
|---|---|
| Saturated polyester resin (saturated polyester resin obtained by a condensation polymerization reaction of an ethylene oxide (2 mol) adduct of bisphenol A and terephthalic acid; number-average molecular weight = 5000, acid value = 6 mg KOH/g, and glass transition temperature = 68° C.) | 88 parts |
| Crystalline polyester 1 | 5 parts |
| Fine particles (dimethylsillyl silica; AEROSIL R972, manufactured by NIPPON AEROSIL CO., LTD.) | 1.5 parts |
| Colorant 4 | 6 parts |
| Iron complex of a monoazo dye (T-77; manufactured by HODOGAYA CHEMICAL CO., LTD.) | 2 parts |
| Release agent 1 | 4 parts |

The above-described constituent materials of the toner were sufficiently stirred and mixed in a Henschel mixer (Mitsui Miike Chemical Engineering Machinery Co., Ltd.), then kneaded with a twin-screw extruder at 150° C. and cooled. The cooled product was finely pulverized in a jet mill and classified with a dispersion separator to obtain comparative toner particles 8.

A total of 100 parts of the comparative toner particles 8 and 0.8 parts of hydrophobic silica fine particles with a BET value of 300 $m^2/g$ and a number-average diameter of primary particles of 8 nm were mixed in a Henschel mixer (Mitsui Miike Chemical Engineering Machinery Co., Ltd.) to obtain a comparative toner 8. The lamella interlayer spacing in the domains of the crystalline polyester was measured from the cross-sectional image of the comparative toner 8 observed with the scanning transmission electron microscope (STEM), and the domains of the crystalline polyester were confirmed to be the domains of the crystalline polyester 1, but the 25% ratio of the crystalline polyester was 42 number %. Physical properties of the comparative toner 8 are shown in Table 4.

TABLE 3

| | Colorant | | Crystalline polyester | | Paraffin wax | | Ester wax | | |
|---|---|---|---|---|---|---|---|---|---|
| | Type | Number of parts | Type | Number of parts | Type | Number of parts | Type | Number of parts | Cooling step |
| Toner 1 | 1 | 90 | 1 | 5.0 | Release agent 3 | 8.0 | Release agent 4 | 5.0 | Ice cooling 1 |
| Toner 2 | 1 | 90 | 1 | 5.0 | Release agent 3 | 8.0 | Release agent 4 | 5.0 | Heat treatment at 55° C. |
| Toner 3 | 2 | 90 | 1 | 5.0 | Release agent 3 | 8.0 | Release agent 4 | 5.0 | Ice cooling 1 |
| Toner 4 | 3 | 90 | 1 | 5.0 | Release agent 3 | 8.0 | Release agent 4 | 5.0 | Ice cooling 1 |
| Toner 5 | 4 | 90 | 1 | 5.0 | Release agent 3 | 8.0 | Release agent 4 | 5.0 | Ice cooling 1 |
| Toner 6 | 5 | 6.8 | 1 | 5.0 | Release agent 3 | 8.0 | Release agent 4 | 5.0 | Ice cooling 1 |
| Toner 7 | 5 | 6.8 | 1 | 5.0 | Release agent 1 | 8.0 | Release agent 4 | 5.0 | Ice cooling 1 |
| Toner 8 | 5 | 6.8 | 1 | 5.0 | Release agent 2 | 8.0 | Release agent 4 | 5.0 | Ice cooling 1 |
| Toner 9 | 5 | 6.8 | 1 | 5.0 | Release agent 2 | 15.0 | Release agent 4 | 5.0 | Ice cooling 1 |
| Toner 10 | 5 | 6.8 | 2 | 5.0 | Release agent 2 | 3.0 | Release agent 4 | 5.0 | Ice cooling 1 |
| Toner 11 | 5 | 6.8 | 2 | 5.0 | None | — | Release agent 4 | 5.0 | Ice cooling 1 |
| Toner 12 | 5 | 6.8 | 2 | 5.0 | None | — | Release agent 4 | 5.0 | Ice cooling 2 |
| Toner 13 | 5 | 6.8 | 2 | 5.0 | None | — | Release agent 4 | 5.0 | Ice cooling 3 |
| Toner 14 | 5 | 6.8 | 2 | 3.0 | None | — | Release agent 5 | 5.0 | Ice cooling 3 |
| Toner 15 | 5 | 6.8 | 2 | 3.0 | None | — | Release agent 6 | 5.0 | Ice cooling 3 |
| Comparative toner 1 | 5 | 6.8 | 1 | 5.0 | Release agent 3 | 5.0 | None | — | Ice cooling 1 |
| Comparative toner 2 | 5 | 6.8 | 1 | 5.0 | None | — | Release agent 4 | 5.0 | Ice cooling 4 |
| Comparative toner 3 | 5 | 6.8 | 1 | 5.0 | None | — | Release agent 4 | 10.0 | Ice cooling 1 |
| Comparative toner 4 | 5 | 6.8 | 2 | 5.0 | None | — | Release agent 4 | 5.0 | Ice cooling 2 |
| Comparative toner 5 | 5 | 6.8 | 2 | 5.0 | None | — | Release agent 4 | 5.0 | Ice cooling 3 |

TABLE 4

| | Crystalline polyester | | | Release agent | | |
|---|---|---|---|---|---|---|
| | Number-average major diameter of domains (nm) | Number of domains (number) | 25% ratio (number %) | Ratio of total area of domains of release agent (area %) | Center point ratio (number %) | Thermal conductivity (W/(m · K)) |
| Toner 1 | 100 | 60 | 70 | 20.0 | 90 | 0.236 |
| Toner 2 | 200 | 8 | 70 | 20.0 | 90 | 0.236 |
| Toner 3 | 100 | 60 | 70 | 20.0 | 90 | 0.220 |
| Toner 4 | 100 | 60 | 70 | 20.0 | 90 | 0.210 |
| Toner 5 | 100 | 60 | 70 | 20.0 | 90 | 0.200 |
| Toner 6 | 100 | 60 | 70 | 20.0 | 90 | 0.150 |
| Toner 7 | 100 | 60 | 70 | 20.0 | 80 | 0.150 |
| Toner 8 | 100 | 60 | 70 | 20.0 | 70 | 0.150 |
| Toner 9 | 100 | 60 | 80 | 30.0 | 70 | 0.150 |
| Toner 10 | 100 | 60 | 65 | 5.0 | 70 | 0.150 |
| Toner 11 | 100 | 60 | 65 | 4.0 | 0 | 0.150 |
| Toner 12 | 300 | 8 | 60 | 4.0 | 0 | 0.150 |
| Toner 13 | 50 | 500 | 60 | 4.0 | 0 | 0.150 |
| Toner 14 | 50 | 8 | 60 | 2.0 | 0 | 0.150 |
| Toner 15 | 50 | 8 | 60 | 1.0 | 0 | 0.150 |
| Comparative toner 1 | Not formed | — | — | 20.0 | 20 | 0.150 |
| Comparative toner 2 | 500 | 3 | 60 | 4.0 | 0 | 0.150 |

TABLE 4-continued

| | Crystalline polyester | | | Release agent | | |
|---|---|---|---|---|---|---|
| | Number-average major diameter of domains (nm) | Number of domains (number) | 25% ratio (number %) | Ratio of total area of domains of release agent (area %) | Center point ratio (number %) | Thermal conductivity (W/(m · K)) |
| Comparative toner 3 | 30 | 1000 | 60 | 5.0 | 0 | 0.150 |
| Comparative toner 4 | 300 | 8 | 55 | 4.0 | 0 | 0.150 |
| Comparative toner 5 | 50 | 500 | 55 | 4.0 | 0 | 0.150 |
| Comparative toner 6 | 100 | 100 | 42 | 10.0 | 5 | 0.150 |
| Comparative toner 7 | 100 | 100 | 42 | 7.0 | 5 | 0.150 |
| Comparative toner 8 | 100 | 100 | 42 | 5.0 | 5 | 0.150 |

Example 1

Developing Performance

The following evaluation was performed using the toner 1.

A commercially available LaserJet P2055 (manufactured by Hewlett-Packard Company) was used as an image forming apparatus, the diameter of the developing sleeve was changed to 10 mm, and the printing speed was changed from 35 prints/min to 45 prints/min. As a result, rigorous evaluation in which the developing performance of the toner was decreased could be performed. Color laser copy paper of an A4 type (manufactured by Canon Inc., 80 g/m$^2$) was used.

A solid image was continuously printed 10 times as a printing procedure. The image density of the resulting 10 solid images was measured using a Macbeth reflection densitometer (manufactured by Macbeth Corporation), and the average value thereof was taken as a solid image density. A higher solid density means betted developing performance. The evaluation results are presented in Table 5.

(Low-Temperature Fixability)

The following evaluation was performed using the toner 1.

The evaluation was performed under an environment at 23° C. and 50% RH. FOX RIVER BOND paper (110 g/m$^2$) was used for fixing medium. By using the medium in the form of thick paper with a comparatively large surface unevenness, it was possible to evaluate rigorously the low-temperature fixability under facilitated rubbing conditions. The apparatus used for evaluating the developing performance was used as an image forming apparatus. Since the printing speed was increased, the low-temperature fixability could be evaluated more rigorously.

In the evaluation procedure, from the state in which the entire fixing unit was cooled to room temperature, a halftone image was outputted to the FOX RIVER BOND paper by adjusting the image density (measured with a Macbeth reflection densitometer; manufactured by Macbeth Corporation) to at least 0.75 and not more than 0.80 at a set temperature of 130° C. The fixed halftone image was rubbed 10 times with lens-cleaning paper to which a load of 55 g/cm$^2$ was applied. The density decrease rate at 130° C. was calculated from the halftone image density before and after the rubbing by using the following formula.

Density decrease rate(%)=[(Image density before rubbing)−(Image density after rubbing)]/(Image density before rubbing)×100.

The density decrease rate was similarly calculated by increasing the fixation temperature by 5° C. to 190° C. Second-order polynomial approximation was performed from the fixation temperature and the evaluation results of the density decrease rate which were obtained in the above-described series of operations. The temperature at which the density decrease rate became 15% was calculated from the resulting polynomial, and this temperature was taken as the fixation temperature serving as a threshold for good low-temperature fixability. Where the fixation temperature is low, it indicates a better low-temperature fixability. The resulting fixation temperature was taken as a low-temperature fixability and presented in Table 5.

(Hot Offset Resistance)

The following evaluation was performed using the toner 1.

The evaluation was performed under an environment at 23° C. and 50% RH. The apparatus used for evaluating the developing performance was used as an image forming apparatus.

Color laser copy paper of a B5 type (manufactured by Canon Inc., 40 g/m$^2$) was used as the fixing medium. As a result of reducing the surface area of the fixing medium, the fixing unit easily retained excessive heat, and by using thin paper, the amount of heat taken by the paper from the fixing unit was reduced. In such investigation, the toner easily received excessive heat and the hot offset resistance was rigorously evaluated.

In the evaluation procedure, from the state in which the entire fixing unit was cooled to room temperature, a solid image was continuously printed 10 times on the abovementioned fixing medium at a set temperature of 170° C., and the occurrence of white dots in the image which were derived from hot offset was checked for the tenth print where the hot offset was most liable to occur.

Similarly, the set temperature was continuously increased by 1° C. and the temperature at which the white dot occurred was taken as a hot offset temperature. Where this temperature is higher, it indicates that the hot offset resistance is better. The resulting hot offset temperature is presented as a hot offset resistance in Table 5.

(Fixing Width)

The fixing width was calculated using the following equation from the results on low-temperature fixability and hot offset resistance obtained in the above-described evaluation.

Fixing width(° C.)=[(Result on hot offset resistance)−(Result on low-temperature flexibility)]

A high fixing width ensured high capability of adapting to various usage environments relating to fixing performance. The resulting fixing width is presented in Table 5.

Examples 2 to 15, Comparative Examples 1 to 8

The evaluation was conducted in the same manner as in Example 1 by using toners 2 to 15 and comparative toners 1 to 8. The results obtained are presented in Table 5.

TABLE 5

| | Toner | Solid image density | Low-temperature fixability (° C.) | Hot offset resistance (° C.) | Fixing width (° C.) |
|---|---|---|---|---|---|
| Example 1 | Toner 1 | 1.45 | 150 | 220 | 70 |
| Example 2 | Toner 2 | 1.45 | 152 | 220 | 68 |
| Example 3 | Toner 3 | 1.45 | 152 | 220 | 68 |
| Example 4 | Toner 4 | 1.45 | 154 | 220 | 66 |
| Example 5 | Toner 5 | 1.42 | 158 | 220 | 62 |
| Example 6 | Toner 6 | 1.42 | 160 | 200 | 40 |
| Example 7 | Toner 7 | 1.42 | 160 | 198 | 38 |
| Example 8 | Toner 8 | 1.42 | 160 | 194 | 34 |
| Example 9 | Toner 9 | 1.41 | 160 | 194 | 34 |
| Example 10 | Toner 10 | 1.42 | 160 | 194 | 34 |
| Example 11 | Toner 11 | 1.41 | 162 | 189 | 27 |
| Example 12 | Toner 12 | 1.41 | 163 | 189 | 26 |
| Example 13 | Toner 13 | 1.41 | 162 | 189 | 27 |
| Example 14 | Toner 14 | 1.41 | 165 | 187 | 22 |
| Example 15 | Toner 15 | 1.41 | 165 | 187 | 22 |
| Comparative Example 1 | Comparative toner 1 | 1.40 | 175 | 190 | 15 |
| Comparative Example 2 | Comparative toner 2 | 1.39 | 170 | 190 | 20 |
| Comparative Example 3 | Comparative toner 3 | 1.39 | 160 | 180 | 20 |
| Comparative Example 4 | Comparative toner 4 | 1.41 | 163 | 181 | 18 |
| Comparative Example 5 | Comparative toner 5 | 1.41 | 162 | 181 | 19 |
| Comparative Example 6 | Comparative toner 6 | 1.41 | 160 | 179 | 19 |
| Comparative Example 7 | Comparative toner 7 | 1.42 | 161 | 178 | 17 |
| Comparative Example 8 | Comparative toner 8 | 1.42 | 159 | 179 | 20 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-237727, filed Dec. 4, 2015, which is hereby incorporated by reference herein in its entirety.

What is claimed is:

1. A toner comprising a toner particle containing a binder resin, a colorant, a crystalline polyester, and a release agent, wherein when a cross-sectional image of the toner is observed using a scanning transmission electron microscope, 8-500 domains of the crystalline polyester are present in the cross-sectional image of the toner, the domains having a number-average major diameter of at least 50 nm and not more than 300 nm, a ratio of the domains present in an area from an outline of the cross-sectional image to 25% of a distance between the outline and a centroid of the cross-sectional image, to a total number of the domains present in the cross-sectional image of the toner is 60 to 100 number %, domains of the release agent are present in the cross-sectional image, and a ratio of a total area of the domains of the release agent to an area of the cross-sectional image of the toner is 5.0 to 30.0 area %.

2. The toner according to claim 1, wherein a ratio of the toner at which the domains of the release agent are present in the centroid of the cross-sectional image is at least 80 number % of the toner.

3. The toner according to claim 1, wherein the colorant includes a magnetic body.

4. The toner according to claim 3, wherein a thermal conductivity of the toner is 0.210 to 1.000 W/(m·K).

5. The toner according to claim 1, wherein the binder resin includes a styrene-acrylic resin.

6. The toner according to claim 1, wherein the release agent includes an ester compound of a dihydric alcohol and an aliphatic monocarboxylic acid, or an ester compound of a divalent carboxylic acid and an aliphatic monoalcohol.

7. The toner according to claim 1, wherein an acid value of the crystalline polyester is 0.5 to 5.0 mg KOH/g.

8. The toner according to claim 1, wherein the release agent further includes an aliphatic hydrocarbon wax.

* * * * *